US006022240A

United States Patent [19]

McCleerey et al.

[11] Patent Number: 6,022,240

[45] Date of Patent: Feb. 8, 2000

[54] POWER CABLE TAP CONNECTOR

[75] Inventors: Earl William McCleerey, Mechanicsburg; Robert Neil Whiteman, Jr., Middletown; Robert Wayne Walker, Harrisburg; Douglas Morgan Walburn, Linglestown; Michael Eugene Shirk, Grantville, all of Pa.

[73] Assignee: The Whitaker Corporation, Wilmington, Del.

[21] Appl. No.: 09/056,083

[22] Filed: Apr. 7, 1998

Related U.S. Application Data

[60] Provisional application No. 60/043,234, Apr. 10, 1997, and provisional application No. 60/064,994, Nov. 10, 1997.

[51] Int. Cl.[7] ..... H01R 4/24

[52] U.S. Cl. ..... 439/410; 439/953

[58] Field of Search ..... 439/409, 410, 439/411, 412, 417, 353, 357, 953, 701; 220/3.8, 4.02, 324

[56] References Cited

U.S. PATENT DOCUMENTS

| | | | |
|---|---|---|---|
| 2,627,537 | 2/1953 | Weisberg | 173/361 |
| 3,877,774 | 4/1975 | Dorrell | 339/99 |
| 3,976,351 | 8/1976 | Hopfe | 339/99 |
| 4,080,034 | 3/1978 | Werner | 339/98 |
| 4,427,253 | 1/1984 | Smith et al. | 339/98 |
| 4,478,471 | 10/1984 | Olsson | 339/74 |
| 4,764,125 | 8/1988 | Debortoli | 439/403 |
| 4,767,354 | 8/1988 | Saligny | 439/413 |
| 4,789,352 | 12/1988 | Kreinberg et al. | 439/260 |
| 4,984,383 | 1/1991 | Mummey et al. | 439/259 |
| 5,006,077 | 4/1991 | Loose et al. | 430/409 |
| 5,007,858 | 4/1991 | Daly et al. | 439/498 |
| 5,139,440 | 8/1992 | Volk et al. | 439/413 |
| 5,154,633 | 10/1992 | Lee | 439/409 |
| 5,186,648 | 2/1993 | Senra | 439/409 |
| 5,302,144 | 4/1994 | Francois et al. | 439/781 |
| 5,394,902 | 3/1995 | Shibao | 220/324 |
| 5,453,022 | 9/1995 | Staiger et al. | 439/404 |
| 5,472,354 | 12/1995 | Chen | 439/357 |
| 5,637,011 | 6/1997 | Meyerhoefer et al. | 439/409 |
| 5,704,801 | 1/1998 | Walker et al. | 439/417 |
| 5,775,953 | 7/1998 | Yamanashi | 439/701 |

OTHER PUBLICATIONS

AMP Catalog 85–766, Streamlined 2–90, CR Connector Systems Zero Insertion Force, pp. 2 through 7, 19 through 21.

*AMP Catalog 82065*, "AMP Mini–Drop Wire Splice", two pages; May 1993; AMP Incorporated, Harrisburg, PA.

*AMP Catalog 65689*, "AMP Mini–Drop Wire Splice", one page; Sep. 1996; AMP Incorporated, Harrisburg, PA.

*AMP Brochure*, "Our mini makes a drop wire splice . . . ", one page; (date unknown); AMP Incorporated, Harrisburg, PA.

*Primary Examiner*—Renee S. Luebke
*Assistant Examiner*—Javaid Nasri

[57] ABSTRACT

A connector (10,200,300) for termination to a multiconductor cable (12,306) along a length thereof at a point remote from an end thereof, such as after installation of the cable within a premises, and including a housing (20,202,302) and a cover (22,204,304) securable to each other around the cable. The housing contains a plurality of contacts (60,220, 320) with first contact sections (66,234,328) in slots (62, 236,330) that open onto the cable face adjacent the cable jacket. Upon actuation of actuators (90,222,326), the contacts associated with the actuators are urged downwardly against the cable jacket, penetrating the jacket (14) and compressively engaging the cable's conductors (16). Second contact sections (68,232,348) are exposed along the mating face (72,214,310) of the connector for mating with complementary contacts of an interface module (400).

40 Claims, 21 Drawing Sheets

POWER CABLE TAP CONNECTOR

This appln claims the benefit of Provisional Appln Nos. 60/043,234, filed Apr. 10, 1997 and 60/064,994 filed Nov. 10, 1997.

FIELD OF THE INVENTION

This relates to the field of electrical connectors and more particularly to connectors for establishing a tap connection to multiconductor cable.

BACKGROUND OF THE INVENTION

For establishing taps to cables such as heavily jacketed cables having a plurality of conductors for transmission of electrical power, especially direct current power, or transmission of both power and signals, it is desired to provide a connector that is easily appliable to the cable with only standard tools, at a point of the cable remote from an end thereof.

It is further desired to provide a connector that may be applied after the cable has been routed through a premises.

In U.S. Pat. No. 5,704,801 issued Jan. 6, 1998 and assigned to the assignee hereof, a connector is disclosed that is applied to a cable and includes an actuator on one connector portion that is of a type rotatable by use of a wrench to urge one connector portion toward and against the other cable portion containing the contacts, the cable being nested therebetween, to urge ends of bifurcated contacts into the cable outer jacket such that respective conductors of the cable are received into slots between the contact beams where beam edges compress against the conductor to establish electrical connections between the contacts and the respective conductors; a mating face of the connector allows mating with another connector to establish subsequent electrical connections such as to a tap cable.

SUMMARY OF THE INVENTION

The electrical connector includes a pair of insulative members movable together about a cable length and that are secured together with the cable nested in position. For each conductor of the cable, at least one contact is contained in a first insulative member or housing and includes a slotted conductor-engaging section aligned with the conductor. An actuator of the connector is moved such as by a tool, to move the contact toward the cable such that the conductor-engaging section penetrates the cable jacket until the conductor therewithin is fully received into the slot, with slot edges compressing against the conductor establishing an electrical connection therewith. The connector defines a mating face for establishing electrical connections with another electrical article such as a tap cable.

In one embodiment, a pair of contacts is associated with each conductor, with a respective actuator rotatable to thread into a threaded aperture of the housing adjacent the pair of contacts and abuts sections of both contacts to move the contact pair along slots of the first insulative member until conductor termination is achieved, such as through insulation displacement.

In another embodiment, two pairs of contacts for two conductors are secured in a respective contact subassembly having an insulative carrier and an actuator. The subassembly is disposed in a cavity of the housing, with a threaded aperture along the cavity bottom adjacent contact-guiding slots of the housing. When the actuator is rotated, the subassembly is moved toward the cable for the two pairs of contacts to be pressed simultaneously against the cable and into the cable jacket, so that cable conductors are received into the slots of the respective pairs of contacts for termination.

In a third embodiment, a capacitor is contained in the connector to eliminate low frequency noise between the power circuits in the connector. A pair of latches enables latching with a mating interface module, a pair of alignment posts assures alignment during mating, a key projection serves as a polarization feature to assure that the mating interface module is properly oriented prior to mating, and a gasket assures sealing of the mating interface after mating.

In aspects of the invention, a terminal subassembly is movable within a housing for at least one contact thereof to become terminated to a cable conductor when the subassembly is moved toward a cable-connecting face of the housing by actuation of an actuator. The actuator may be exposed along a mating face of the housing, may be disposed within a mating face shroud, and may be sealed by an interfacial seal around the shroud upon mating with another connector. One or more latches may extend from the mating face for latching to a mating connector, where each latch is protected by a silo extending mostly therearound.

Embodiments of the present invention will now be described by way of example with reference to the drawings.

DETAILED DESCRIPTION OF THE EMBODIMENTS

Figure 1:
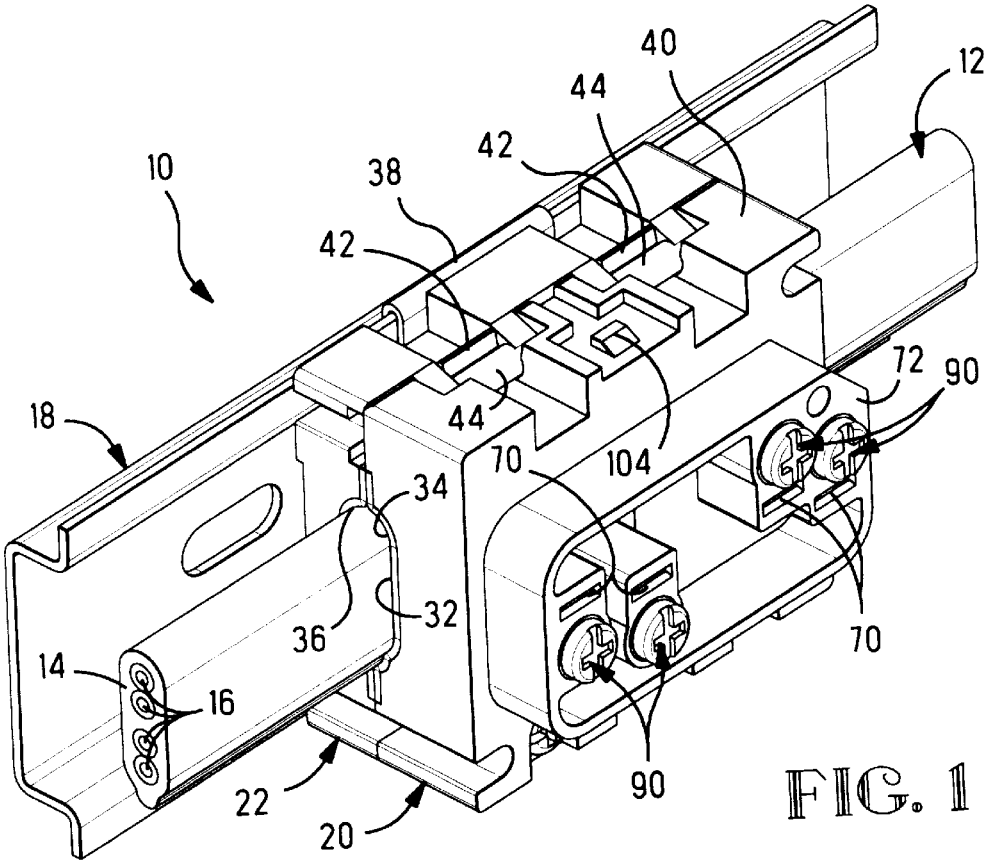
FIG. 1 is an isometric view of a first embodiment of the connector terminated to a cable.

Connector 10 is shown terminated to a cable 12 having an outer jacket 14 and, for example, four conductors 16, with the connector mounted to a DIN rail 18. Connector 10 includes an insulative housing 20 and a second insulative member, cover 22 to which it is securable about cable 12 at a location remote from an end of the cable, as well as at a cable end. Housing 20 and cover 22 include shallow wide grooves 24,26 along assembly faces 28,30 thereof together defining cable-receiving channel or nest 32 that will clamp about the cable. Also shown are gaskets 34,36 such as of elastomeric material that may be affixed to assembly faces 28,30 within respective gasket grooves to seal the termination region from moisture, dust and gasses of the outside environment after termination; alternatively, sheets of mastic material may be used for sealing along grooves 24,26. Bracket 38 is shown securable to cover 22 to enable clamping to the DIN rail 18. The cable cross-section is shown to include a reduced thickness flange along one side, serving to polarize the orientation of the cable tap connector with respect to the cable, its cable-receiving channel being complementarily shaped, thus assuring that the power conductors and signal conductors are positioned appropriately for termination to the appropriate contact members of the connector.

Figure 3:
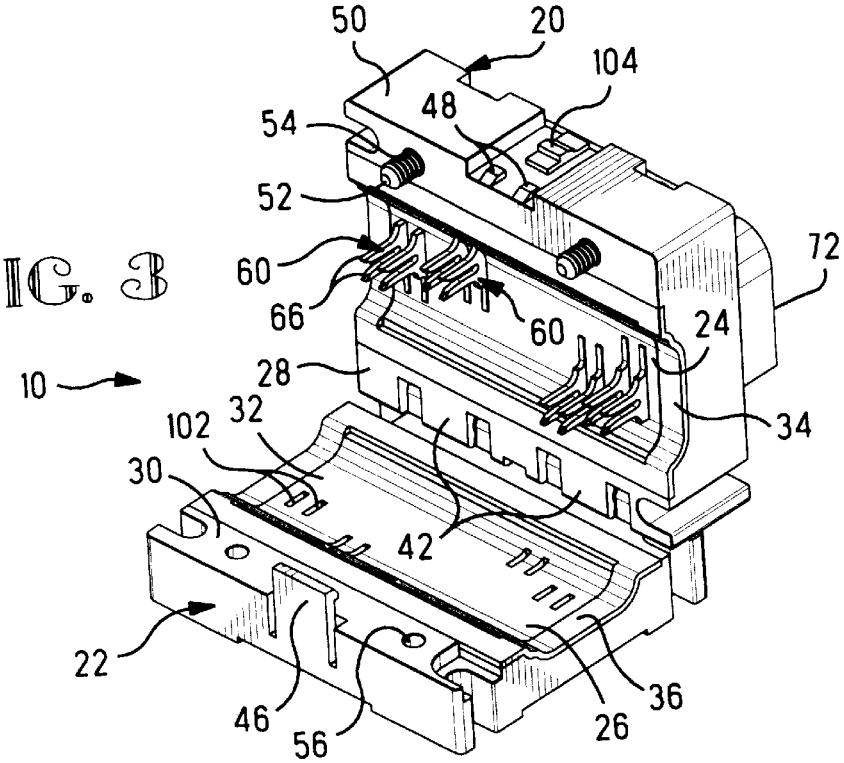
FIG. 3 is an isometric view of the housing and the cooperating member of the connector of FIGS. 1 and 2 hingedly joined in an open condition, but with the contacts shown in the actuated position for illustrative purposes.
Figure 2:
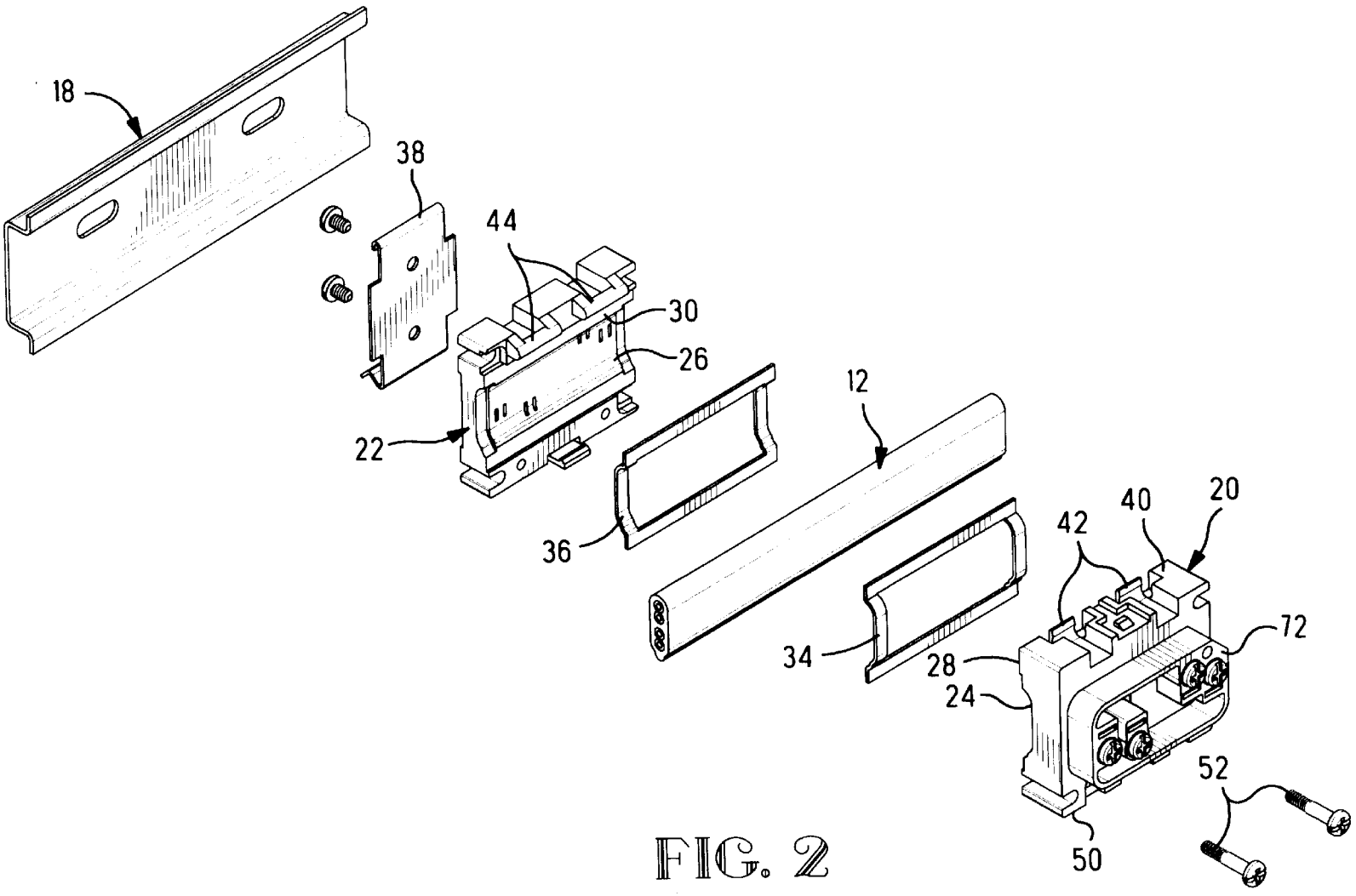
FIG. 2 is an isometric view of the connector of FIG. 1 and a DIN rail to which it may be mounted.

Referring to FIGS. 1 to 3, housing 20 and cover 22 are securable to each other about cable 12; preferably, housing 20 and cover 22 are hingedly joined to each other, to be rotated together for assembly faces 28,30 to meet about the cable for grooves 24,26 to form cable-receiving channel 32. Housing 20 includes along one side 40, a pair of pivot sections 42 cooperable with pivot pins 44 of cover 22 to pivot housing 20 toward cover 22. Latch arm 46 extends upwardly from assembly face 30 of cover 22 on the opposed side from pivot pins 44, to latch with projections 48 of housing 20 along opposed side 50. Fasteners 52 are affixable along the opposed side 50, insertable through holes 54 of housing 20 to thread into apertures 56 of cover 22 to complete securing the housing to the cover prior to cable termination.

Figure 4:
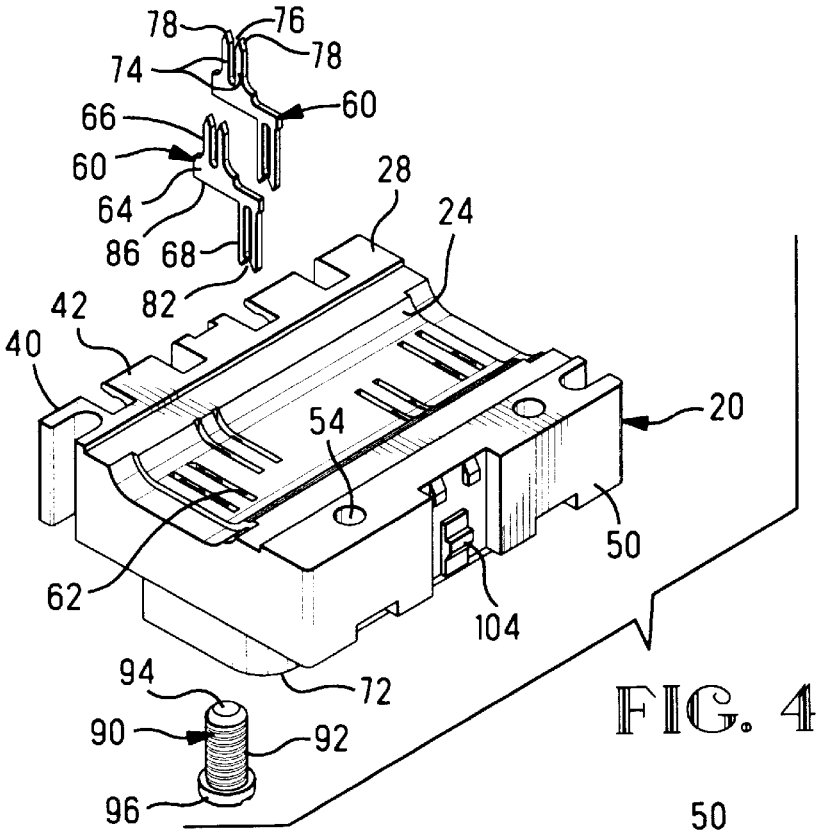
FIG. 4 is an isometric view of the housing with a air of contacts and their actuator exploded therefrom.
Figure 5:
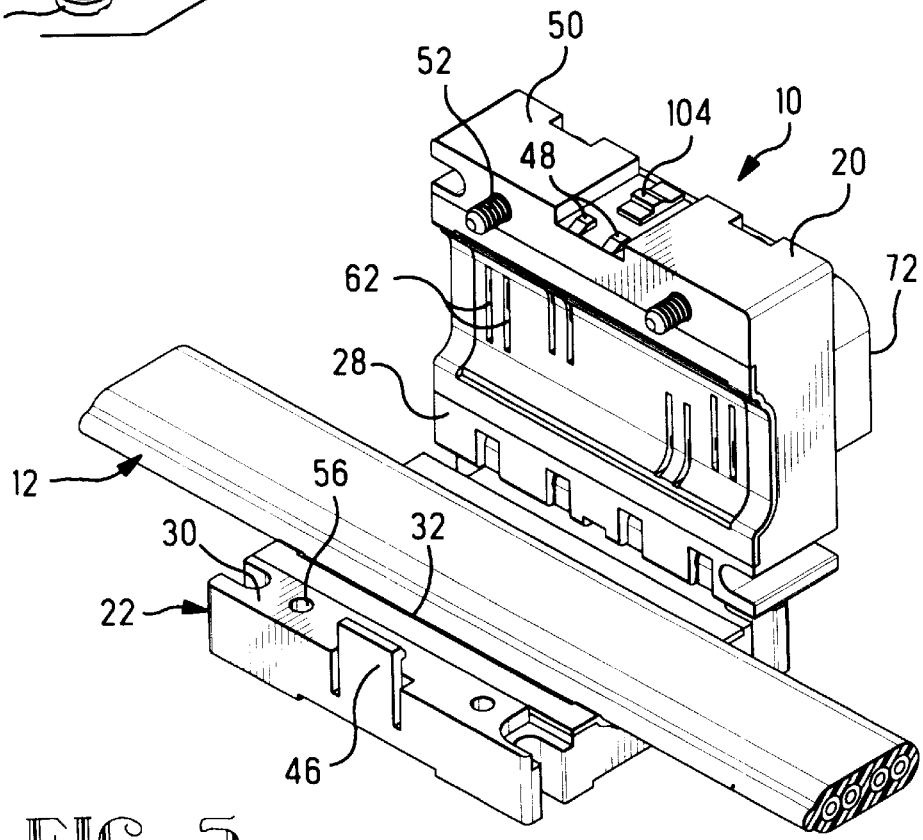
FIG. 5 is an isometric view of the connector of FIGS. 1 to 4 with a cable nested therein, with the contacts recessed prior to termination.
Figure 6:
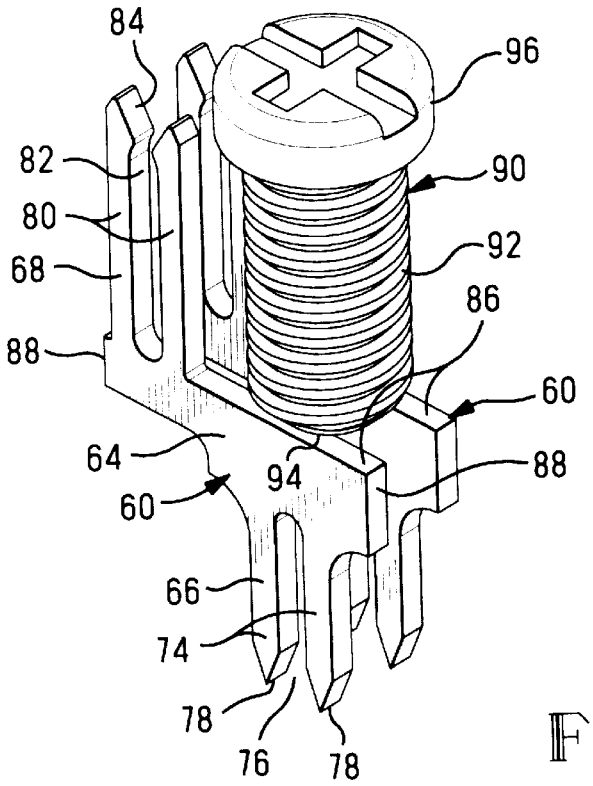
FIG. 6 is an illustrative isometric view of the actuator and associated pair of contacts in operative relationship.

Now referring to FIGS. 3, 4 and 6, connector 10 includes a plurality of contacts 60, each secured such as by a modest force fit, in a respective slot 62 of housing 20 along assembly face 28. Each contact includes a body section 64, a first contact section 66 associated with a conductor 14 of cable 12, and a second contact section 68 associated with a complementary contact of a mating connector (see FIGS. 13 to 15). Second contact section 68 is disposed recessed within a slot 70 along mating face 72 of housing 20. First contact section 66 is disposed within a respective slot 62 opening onto cable channel 32, and is recessed therewithin upon connector assembly prior to cable termination; first contact sections 66 are shown in FIG. 3 in their terminated position, for illustration purposes only. Each first contact section 66 is preferably of the insulation displacement (IDC) type, having a pair of opposed beams 74 defining therebetween a conductor-receiving slot 76, with each beam having a sharp point 78 at the free end to facilitate penetration of cable jacket 14 during termination.

Each contact section 68 defines a pair of cantilever beam arms 80 that provide a blade-receiving slot 82 therebetween extending from an entrance 84. Body section 64 is transversely oriented between the contact sections 66,68 that are horizontally offset, extending between opposed side edges 88, and provides an upper edge that is a push surface 86.

FIG. 6 is illustrative of the relationship between a pair of contacts 60 both associated with the same conductor 16 of cable 12 for termination, and actuator 90. The provision of a pair of contacts engaging each conductor increases the current-carrying capacity of the connector, with attendant advantages of substantially reduced heat generation and related temperature rise and substantially reduced losses, as well as redundancy. Actuator 90 includes a threaded shaft 92 extending to a blunt leading end 94, and also includes a head 96 engaged for actuation by a tool such as a Phillips head screw driver. The actuator, when threaded into housing 20 during actuation, abuts push surfaces 86 defined by transverse body sections 64 of contacts 60, to move both contacts 60 simultaneously downwardly within respective slots 62 of housing 20.

Figure 7:
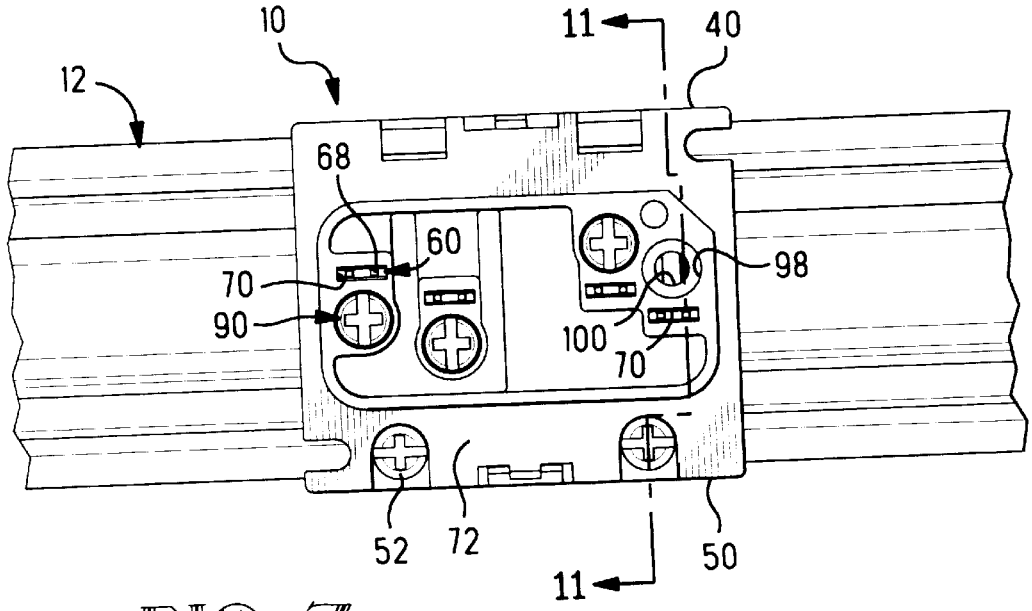
FIG. 7 is a plan view of the connector of FIGS. 1 to 6 applied to the cable, showing the mating interface.

In FIG. 7 is seen the mating face 72 of connector 10, that is also the actuation face whereat actuators 90 are engaged by a tool for rotation during cable termination. Seen in each slot 72 are the contact sections 68 of each pair of redundant contacts 60. One actuator position is illustrated having a large passageway portion 98 for receipt of actuator head 96 thereinto, and smaller diameter passageway portion 100 through which threaded shaft 92 of the actuator is threadedly received.

Figure 9:
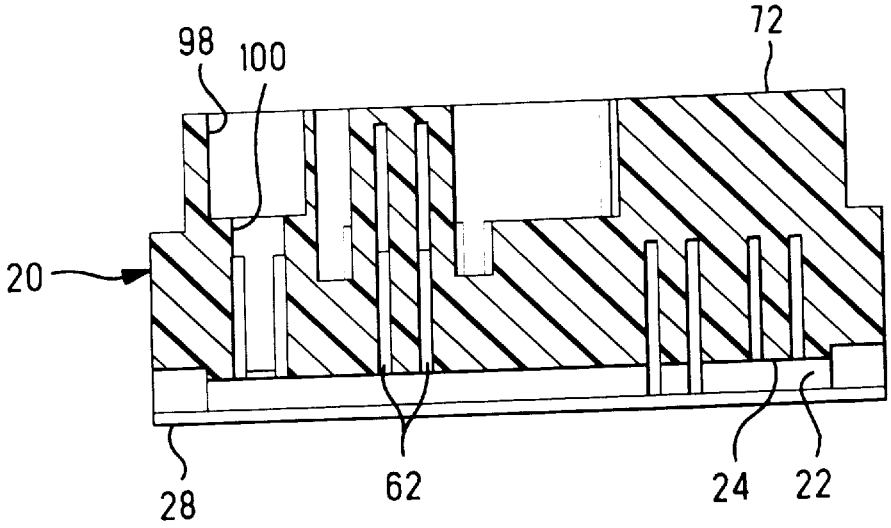
FIG. 9 is a cross-sectional view of the housing of FIG. 8 showing the contact slots taken along lines 9—9 of FIG. 8.
Figure 8:
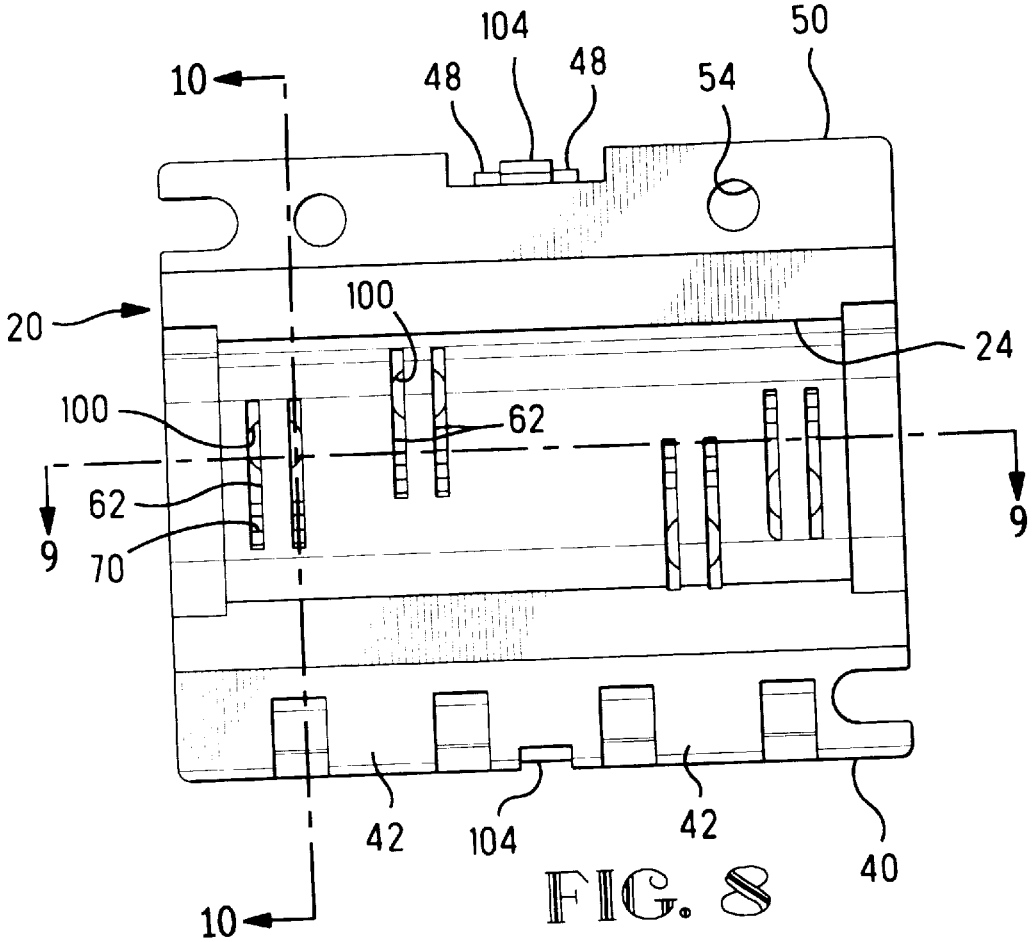
FIG. 8 is a plan view of the housing along the cable face.
Figure 10:
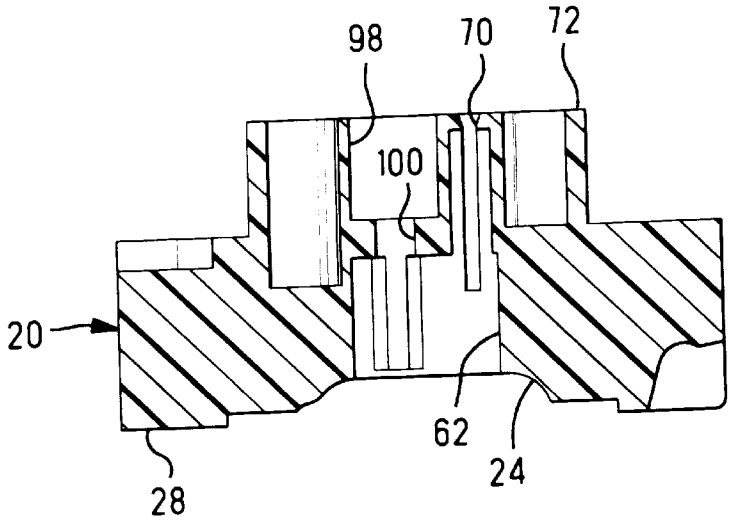
FIG. 10 is a cross-sectional view of the housing showing one contact slot in communication with the actuator-receiving aperture and the contact-receiving slot along the mating interface, taken along lines 10—10 of FIG. 8.

FIG. 8 is a view of the cable face of housing 20, with the slots 62 of all contacts 60 indicated along the groove 24 of the cable-receiving channel, staggered so that the contacts sections 66 of the contacts are aligned with respective conductors of the cable during termination. For each pair of slots 62, a smaller diameter passageway portion 100 is visible, aligned with the slots to engage contacts that will be disposed in the pair of slots. FIG. 9 illustrates housing 20 in longitudinal section, while FIG. 10 shows the housing in lateral section, both intersecting an actuator location and one of the paired slots 62.

Figure 11:
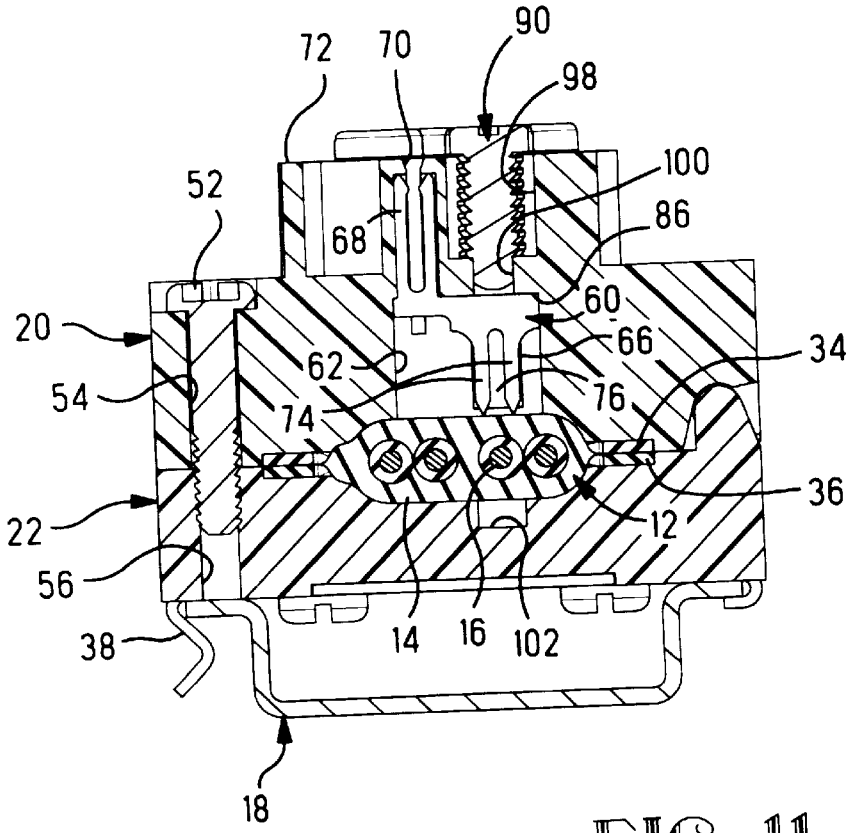
FIG. 11 is a cross-sectional view of the connector of FIGS. 1 to 10 with a cable extending therethrough prior to termination and showing a contact aligned with a conductor and the actuator therefor, taken along lines 11—11 of FIG. 7.
Figure 12:
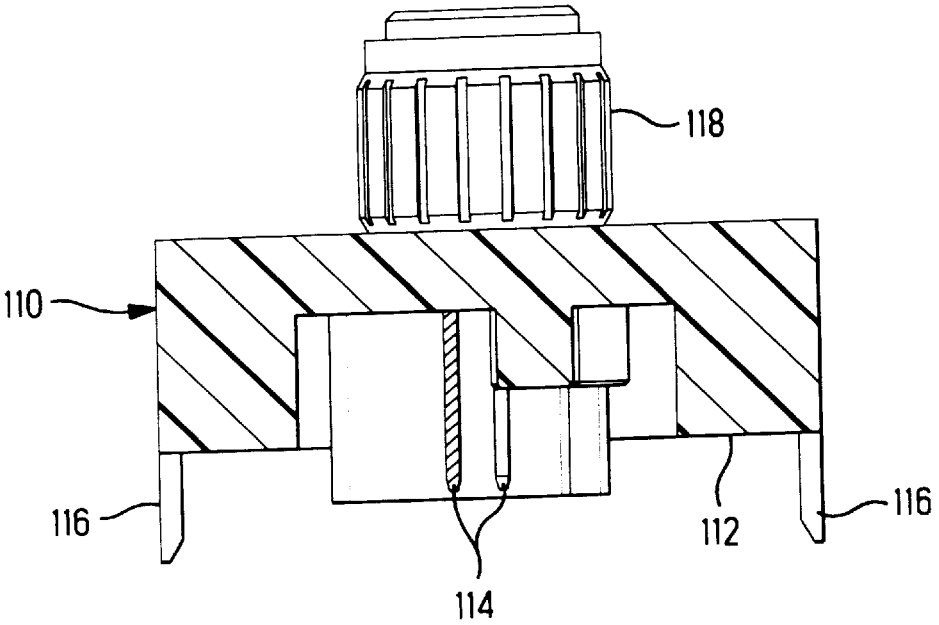
FIG. 12 is a cross-sectional view of the connector similar to FIG. 11, after termination, and showing a mating connector poised to mate therewith.
Figure 12:
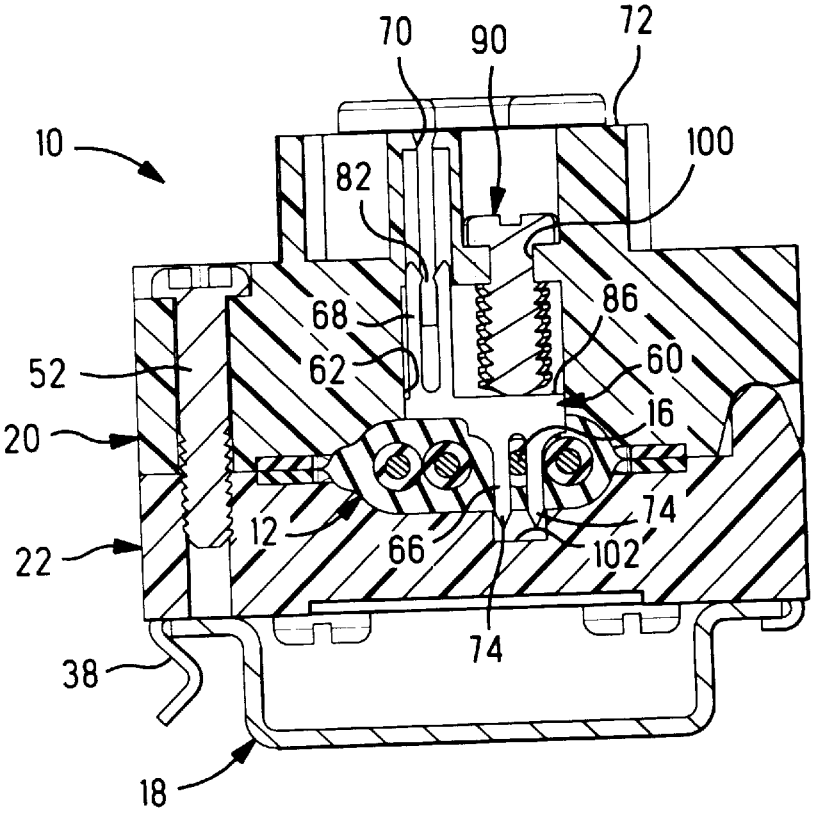

Referring now to FIGS. 11 and 12, connector 10 is shown in cross-section with cable 12 disposed in the cable-receiving channel between housing 20 and cover 22. One contact 60 is seen in a slot 62 above cable 12, with conductor-receiving slot 76 aligned with an associated conductor 16. In FIG. 11, actuator 90 is in the pretermination position, and contact 60 is fully recessed in slot 62. In FIG. 12, actuator 90 has been rotated and has urged contact 60 downwardly to become terminated with conductor 16 seen received in conductor-receiving slot 86 after beams 74 have penetrated the cable jacket 14 and the insulation cover of the discrete conductor, for beam edges to become compressively engaged with the conductor 14. Ends of beams 74 have been received into recesses 102 extending into the cable face of cover 22.

Figure 13:
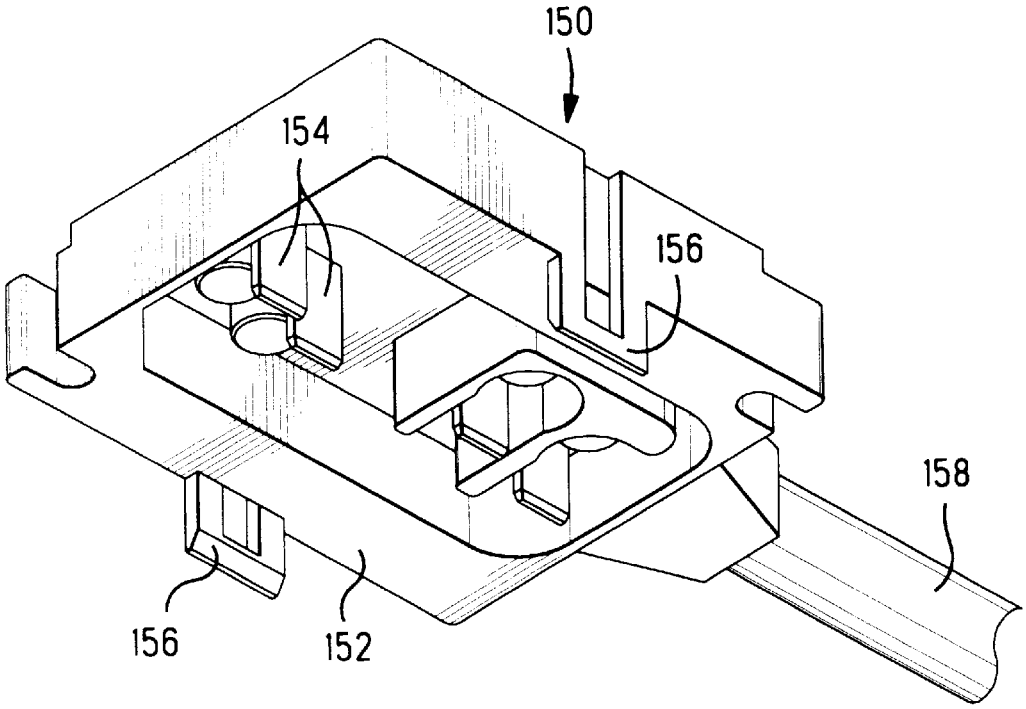
FIGS. 13 and 14 are isometric views of the mating interfaces of two types of mating connector of FIG. 12.
Figure 14:
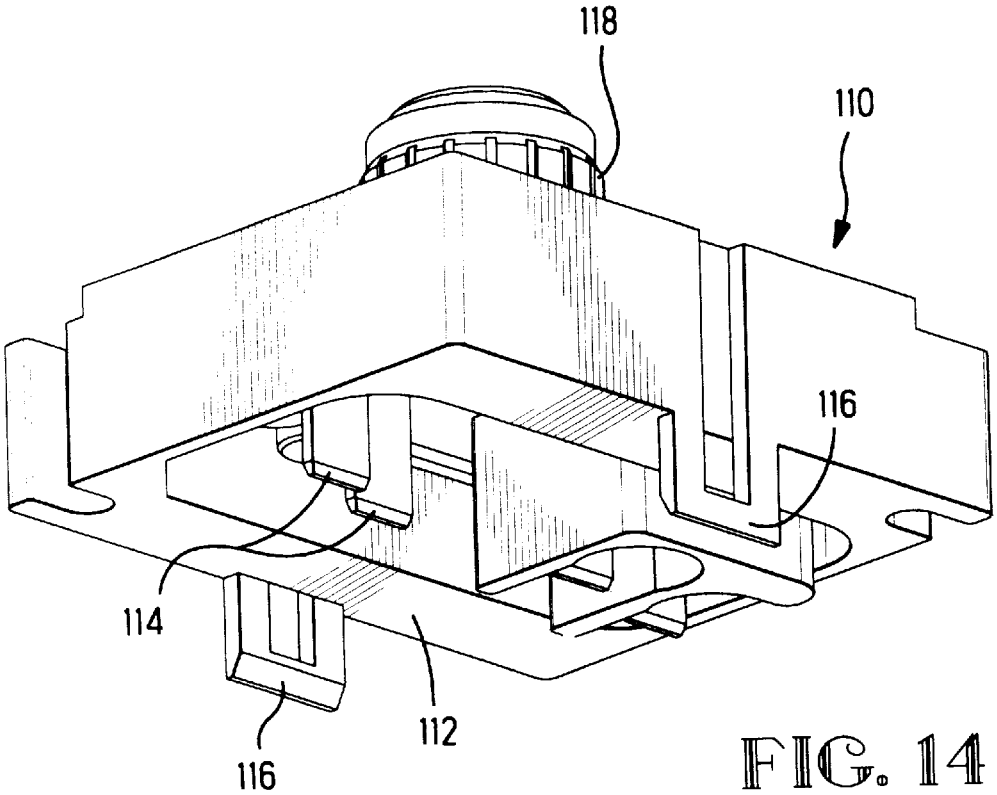
Figure 15:
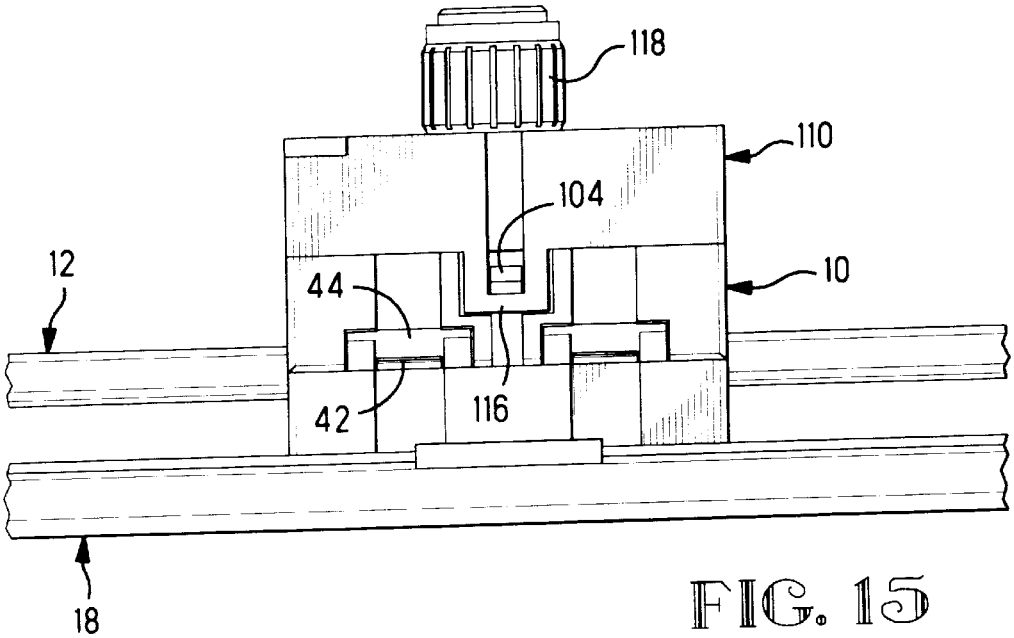
FIG. 15 is an elevation view of the mating connector of FIG. 14 mated to the connector of FIGS. 1 to 12.

Seen in FIG. 14, and also in FIG. 12 positioned above mating face 72 of connector 10, is mating connector 110 having a complementary mating face 112 and a plurality of contacts having blade-shaped contacts sections 114 projecting therefrom to be received into respective slots 70 of connector 10 for electrical connection with contact sections 68 of a respective pair of contacts 60. A pair of opposed latch arms 116 are seen projecting forwardly from sides of connector 110 that will latch with corresponding latch projections 104 of housing 20 of connector 10 (FIGS. 1 and 3) to maintain them in mated engagement after mating, as seen in FIG. 15. Mating connector 110 is shown to have a circular plug section 118 opposed from complementary mating face 112, for mating to a conventional circular connector terminated to a tap cable (not shown). FIG. 13 shows another type of mating connector 150 having a complementary mating face 152 with blade-shaped contact sections 154, and latch arms 156, and is directly terminated to a tap cable 158; mating connector 150 is also matable to connector 10. Other designs of mating connectors are possible, each having a complementary mating face and contacts.

Figure 16:
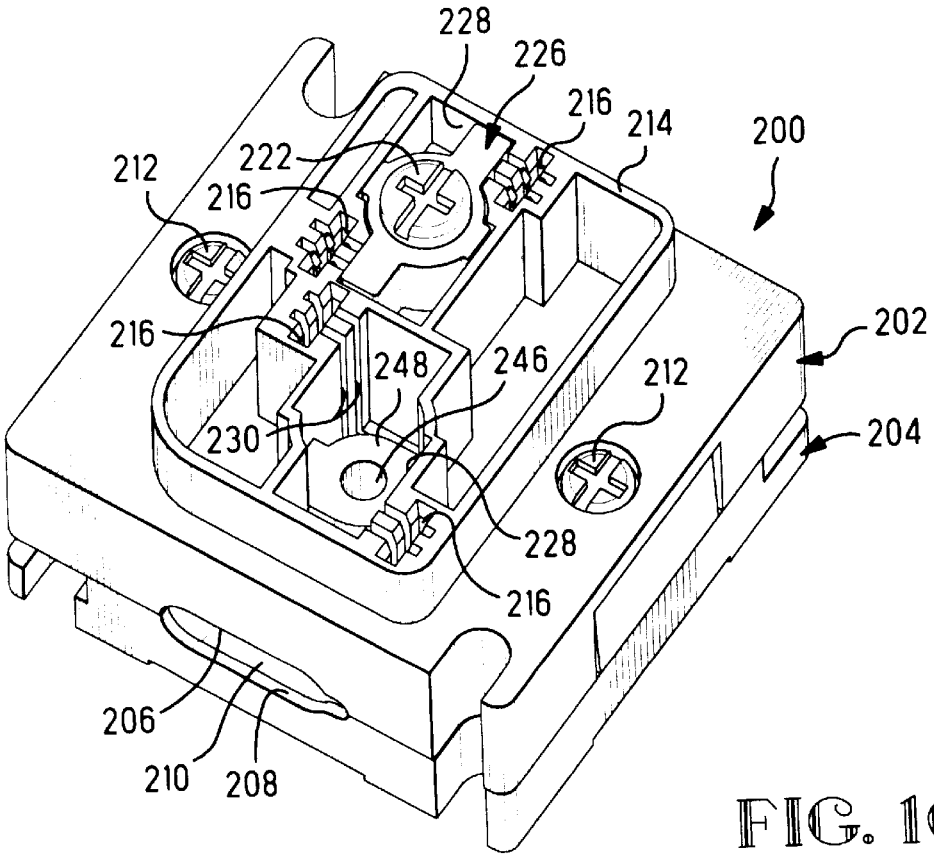
FIG. 16 is an isometric view of a second embodiment of connector of the present invention, showing the mating face, with one contact subassembly removed for illustrative purposes.
Figure 17:
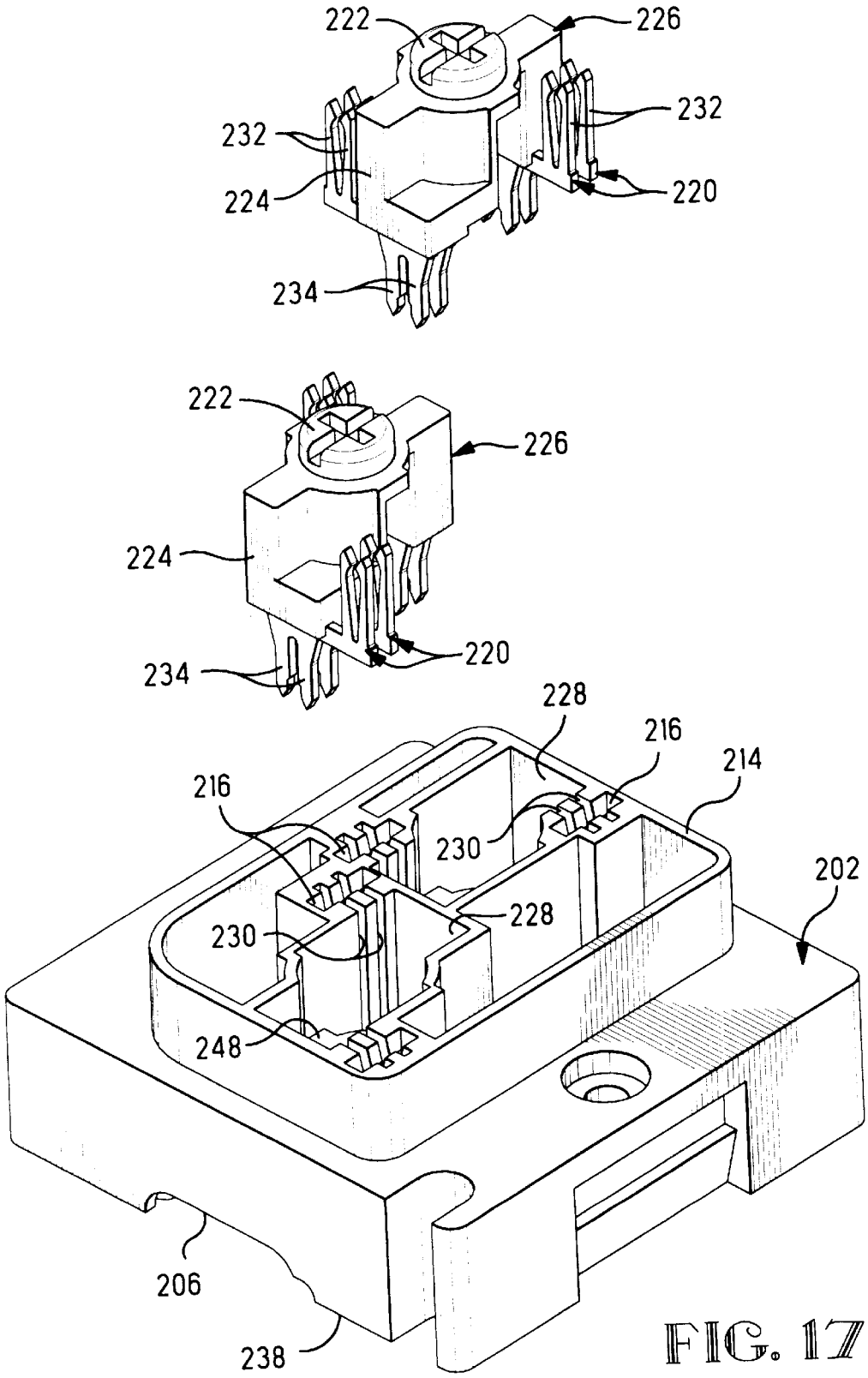
FIG. 17 is an isometric view of the housing of FIG. 16 with both contact subassemblies exploded therefrom.
Figure 18:
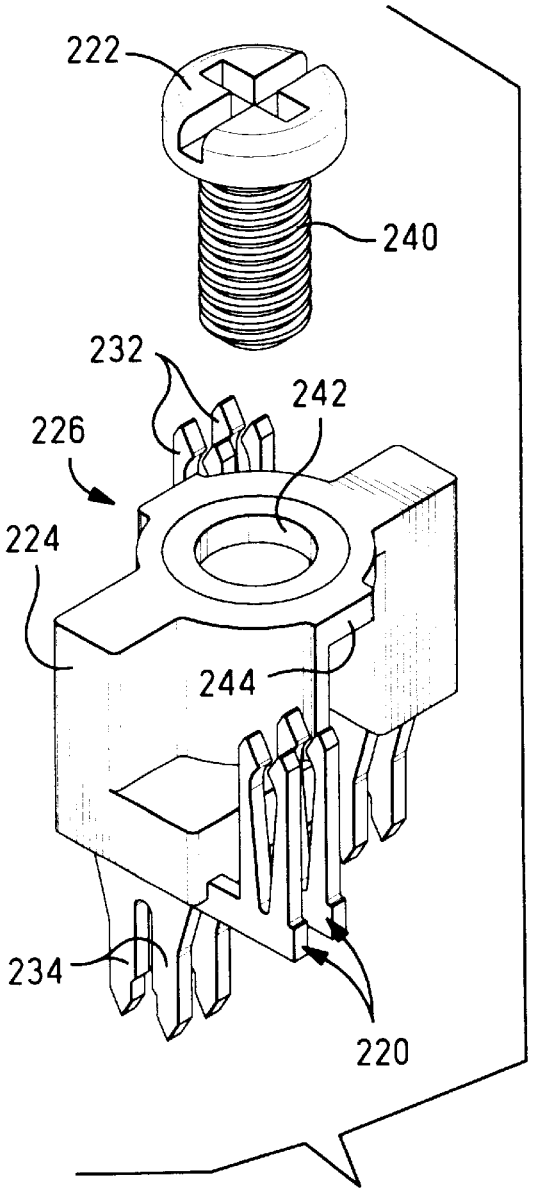
FIGS. 18 and 19 are upper and lower isometric views of a contact subassembly of FIG. 17, with the actuator exploded in FIG. 18.
Figure 19:
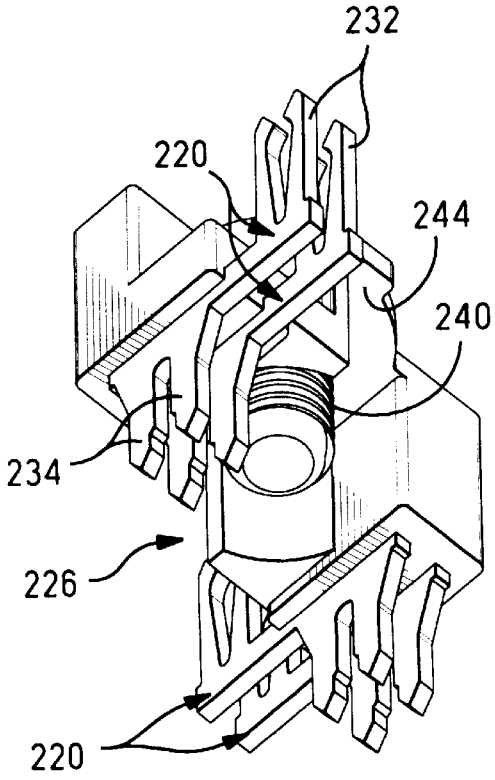
Figure 20:
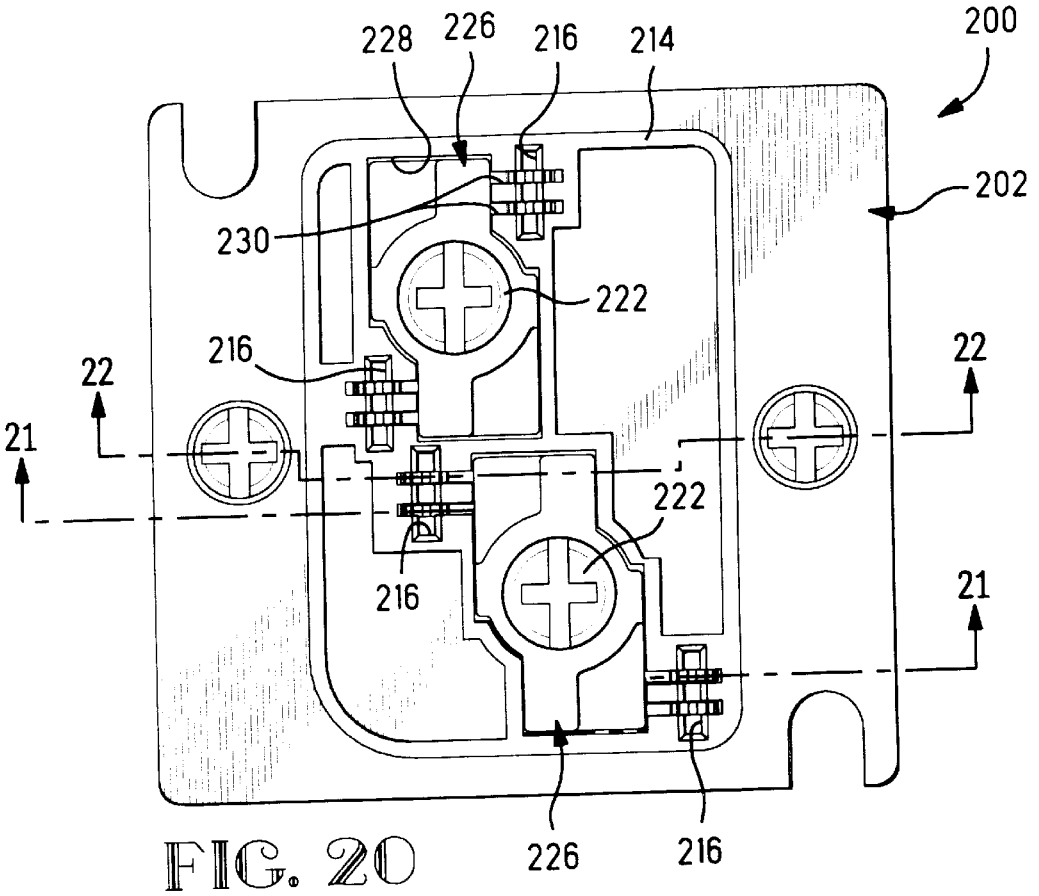
FIG. 20 is a plan view of the mating interface of the housing of FIGS. 16 and 17 fully assembled.

FIGS. 16 to 23 illustrate another embodiment of connector 200 for termination to a cable. As with connector 10, connector 200 includes a housing 202 and cover 204 that having wide shallow grooves 206,208 that together define a cable-receiving channel 210. Housing 202 and cover 204 are latched together and subsequently fastened together with fasteners 212. Mating face 214 is shown in FIGS. 16, 17 and 20, having blade-receiving slots 216 recessed within which are contact sections 218 of pairs of contacts 220 upon complete connector assembly.

In connector 200, a pair of actuators 222 are utilized to actuate two pairs of redundant contacts, with each pair of contacts associated with a respective conductor; actuation of each actuator 222 thus terminates contacts to two conductors at a time. Best seen in FIGS. 17 to 19, the two pairs of contacts 220 and the associated actuator 222 are first assembled into an insulative insert 224 to define a contact subassembly 226 that is inserted into a well 228 along mating face 214 of housing 202 prior to termination.

Figure 21:
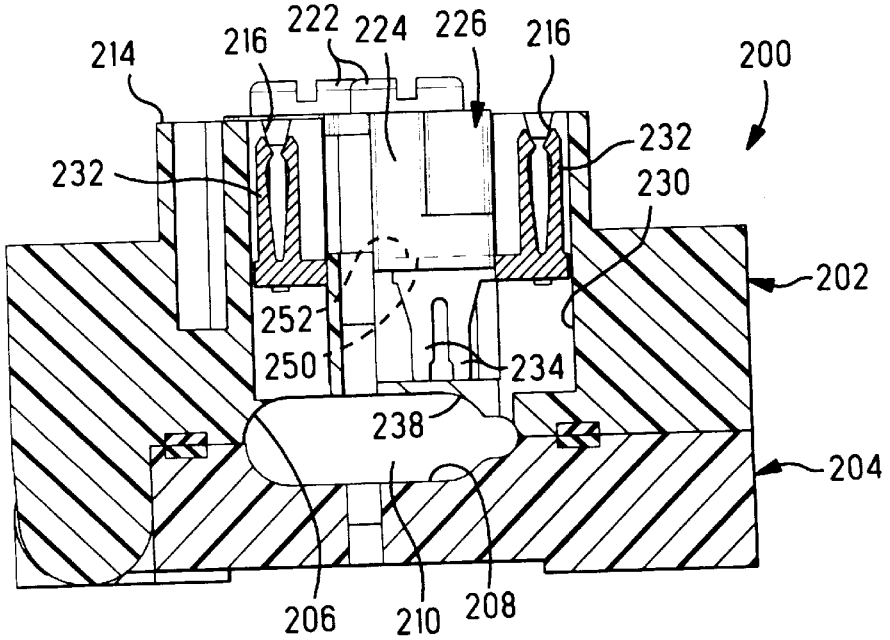
FIG. 21 is a cross-sectional view of the connector of FIGS. 16 to 20 taken along lines 21—21 of FIG. 20, with a contact subassembly in the unterminated position.
Figure 22:
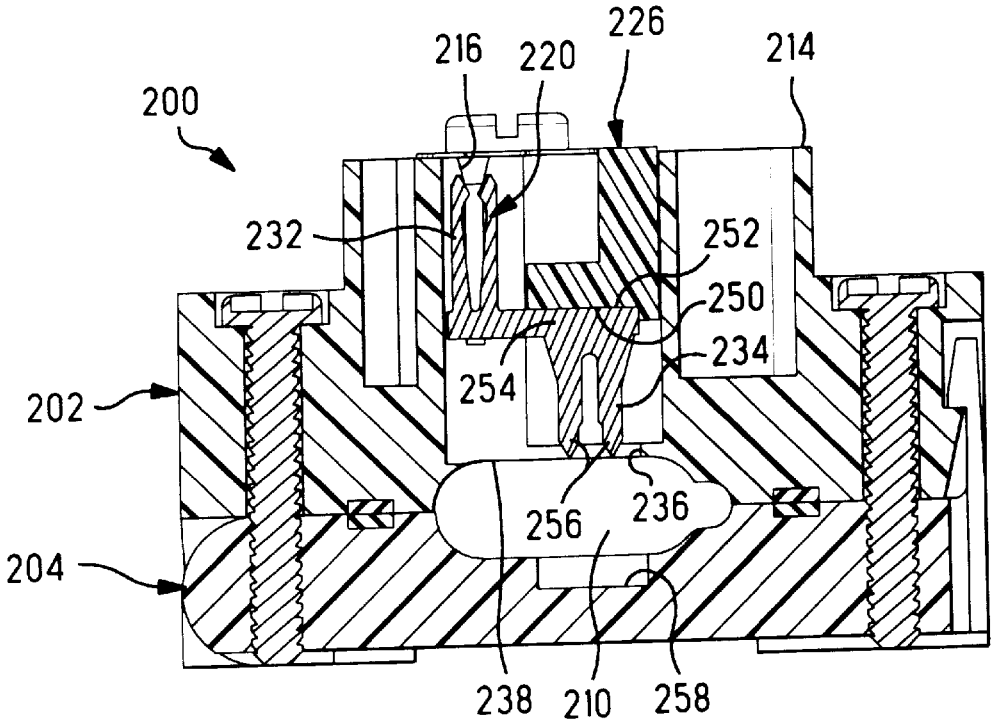
FIG. 22 is a cross-sectional view similar to FIG. 21 taken along lines 22—22 of FIG. 21, showing a contact poised to be actuated by being moved into the cable-receiving channel to terminate a conductor.

Upon insertion of subassembly 226 into well 228, narrow channels 230 allow second contact sections 232 of contacts 220 to pass therealong, and first contact sections 234 are received into corresponding slots 236 in the housing 202 that communicate with assembly face 238 for enabling cable termination (FIGS. 21 and 22). Threaded shaft 240 of actuator 220 extends through hole 242 in transverse upper portion 244 of insert 224 and extends therebelow, and is aligned with opening 246 in raised platform 248 in well 228.

Now referring to FIGS. 21 and 22, after connector assembly, second contact sections 232 are aligned with blade-receiving slots 216 along mating face 214. First contact sections 234 are disposed within slots 236 that communicate with assembly face 238 and open into cable-receiving channel 210. It can be seen as actuator 222 is rotated to thread its threaded shaft 240 into aperture 246 (FIG. 16), subassembly 226 is urged downwardly. Bottom surface 250 of insert 224 applies force to push surface 252 defined along the upper edge of transverse body section 254 of each contact 220, to urge the contacts 220 against a cable disposed along cable-receiving channel 210. First contact sections 234 penetrate the cable jacket and the insulation of the discrete conductors, for termination to the cable conductors in similar fashion to connector 10 of FIGS. 1 to 12. Ends of beams 256 of first contact sections 234 are again seen to be received into recesses 258 of cover 204.

Figure 23:
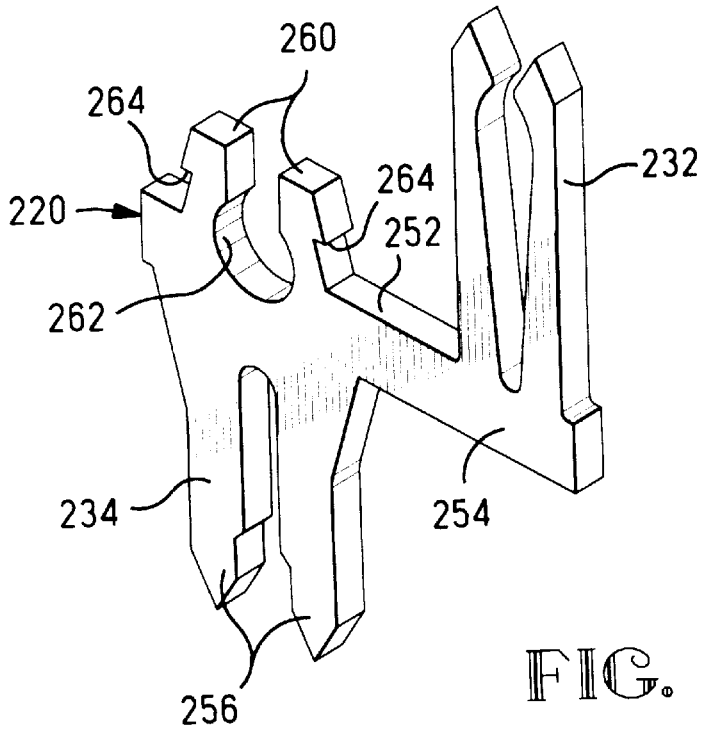
FIG. 23 is an isometric view of a contact of the contact subassembly of FIGS. 18 and 19.
Figure 24:
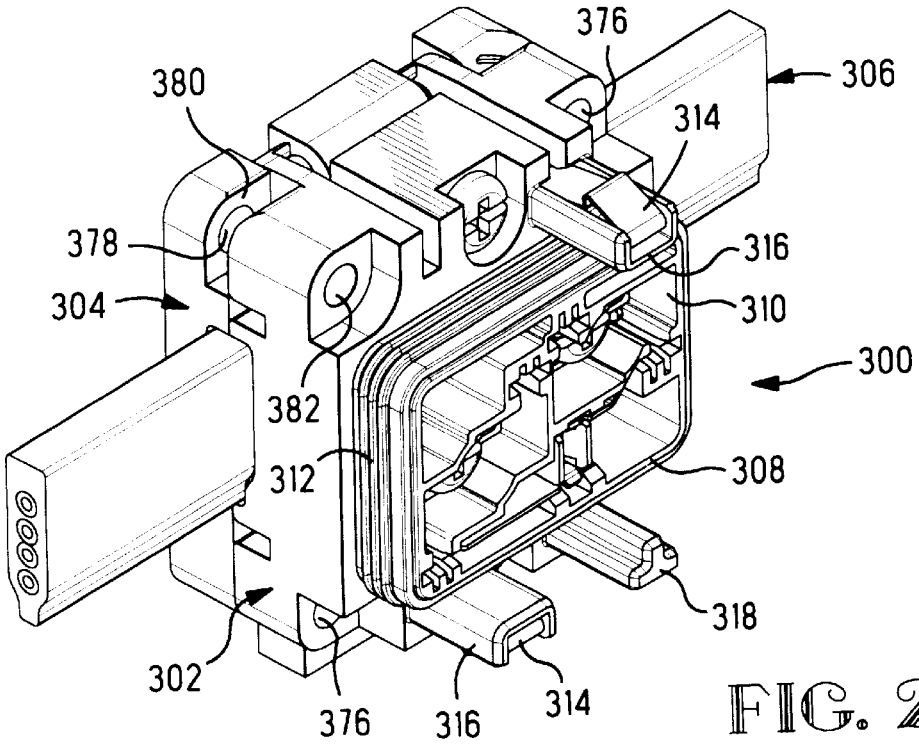
FIG. 24 is an isometric view of a third embodiment of tap connector connected to a cable and defining a mating face.

A contact 220 is shown in FIG. 23 to include a retention section 260 extending from body section 254. With downwardly facing surfaces being defined by a keyhole 262 through retention section 260 defining undercuts and by ledges 264 along outer edges of retention section 260, contact 220 is adapted to be affixed to insert 224 in an insert molding process wherein the insert is molded of plastic material around and below the retention sections of all the contacts simultaneously for assured contact retention to insert 224 and precise contact positioning. However, other conventional techniques may be used to secure the contacts to the insert. Preferably, insulative insert 224, as well as housing 202 and cover 204, are molded of heat resistant material such as liquid crystal polymer.

It can be discerned from FIGS. 17 and 20, that the two pairs of contacts 220 of each subassembly 226 have their first contact sections 234 positioned to assure sufficient dielectric therebetween, both insulative material and air. Positioning of the contacts also is shown that has been selected to accommodate minimizing crossover of conductors of the mating connector secured to a tap cable.

Figure 33:
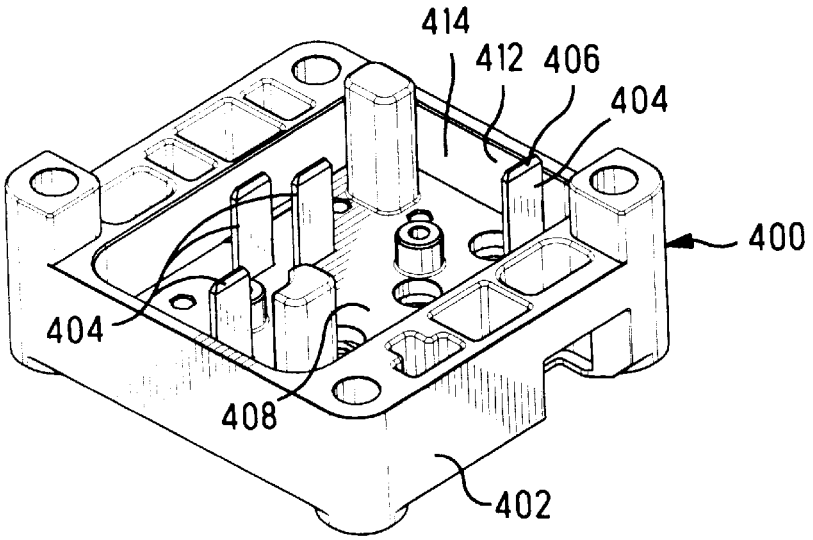
FIG. 33 is an isometric view of the mating interface of an interface module matable with the connector of FIGS. 24 to 32.
Figure 34:
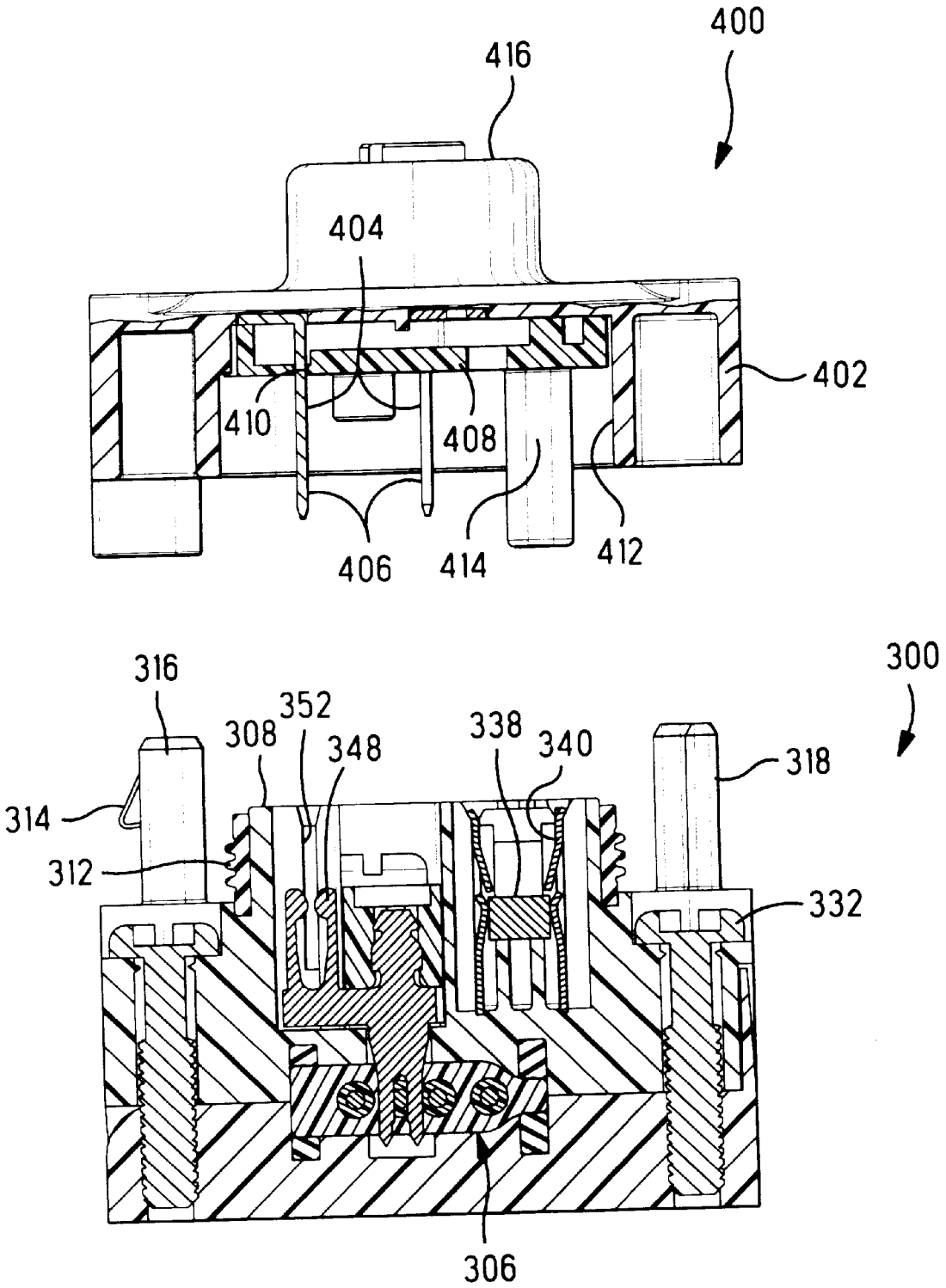
FIG. 34 is a cross-sectional view of the interface module of FIG. 33 positioned to mated with the connector of FIGS. 24 to 32.

FIGS. 24 to 35 illustrate another embodiment of the invention. Tap connector 300 has a housing member 302 and a cover member 304 pivotable therewith to enable clamping around cable 306. Housing 302 is shown to include a shroud 308 extending therefrom and surrounding the mating face, which is defined along a cable-remote face of housing member 302. A sealing gasket 312 of elastomeric material surrounds the outer surface of shroud 308 to seal the mating interface when mated with an interface module (FIGS. 33 and 34).

A pair of latch members 314 have latch arms that extend from housing 302 outside of shroud 308 and beyond the leading transverse end thereof, and are disposed within silos 316 extending from the housing to leading ends of the latch arms that serve to protect the latch members and also to comprise alignment posts to assure alignment with an interface module during mating when received into corresponding apertures of the module, the silos shown having chamfered leading edge corners defining an appropriate lead-in. The silos surround three sides of the latch arms along the entire length, serving to prevent latch arm damage during handling and to prevent overstress of the latch members during deflection. A polarization feature is preferably used, such as T-shaped key projection 318, if the alignment posts are symmetrically disposed, although polarization may be achieved by locating the alignment posts asymmetrically.

Figure 26:
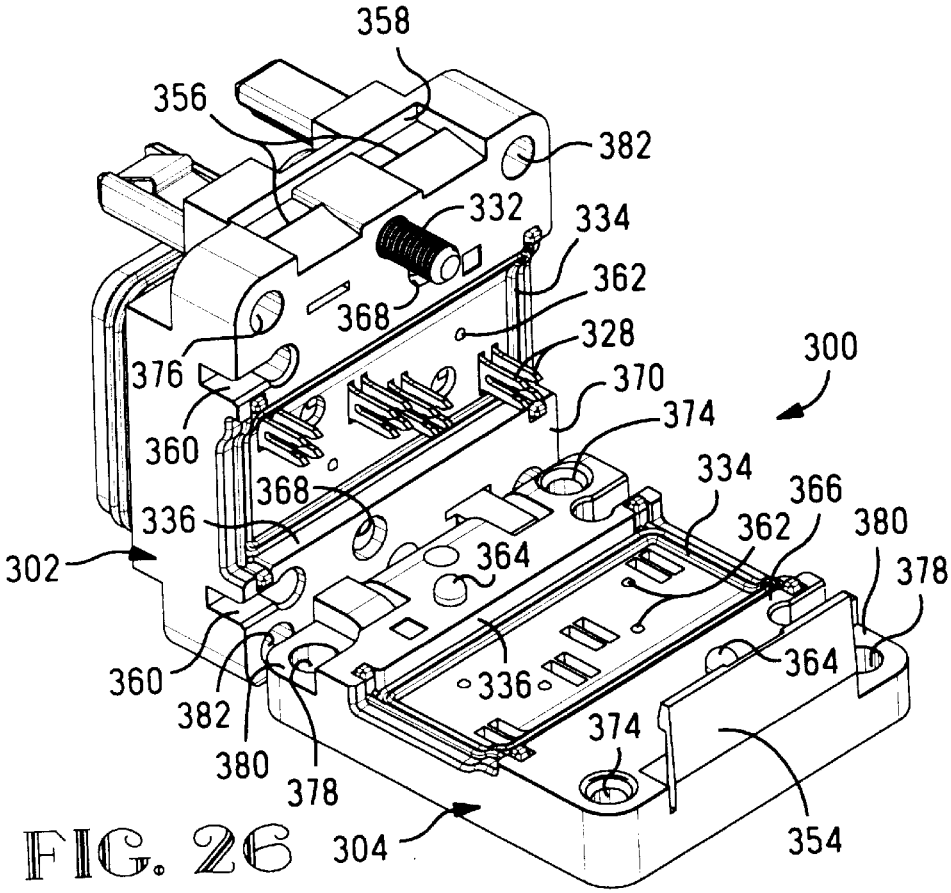
FIGS. 26 and 27 illustrate in isometric view the connector of FIGS. 24 and 25 open to receive a cable thereinto and open after receiving the cable, respectively.

Contacts 320 are contained within insulative carriers or inserts 322 in two pairs per insert to define terminal subassemblies 324, as in connector 200 of FIGS. 16 to 23, with actuators 326 cooperating with the housing and rotatable to move the subassemblies and the contacts. Actuation sections of the actuators preferably are exposed along the mating face, are seated within a shroud therearound, and are sealed by an interfacial seal around the shroud upon securing the mating interface module thereto. The mating interface module may include embossments that will abut an actuator 326 and prevent full mating if the actuator has not been fully rotated to terminate the contacts appropriately with the cable conductors. IDC contact sections 328 are seen in FIG. 26 in their fully terminated position, extending outwardly from slots 330, although prior to the connector being fastened around the cable the contacts are fully retracted into slots 330 as in FIG. 27. When connector 300 is applied to cable 306, latch arm 354 of cover 304 is received into a latch-receiving recess 356 and latched to corresponding latching ledges 358 of housing 302, with the latch-receiving recess being a tamper-resistance feature to inhibit delatching of latch arm 354. Fasteners 332 then assuredly secure housing 302 to cover 304 about the cable, after which termination is then able to be performed by actuation of terminal subassemblies 324.

Gaskets 334 are shown secured to housing 302 and cover 304 seated within in respective grooves adjacent to cable-receiving grooves 336 (see FIG. 30), that will establish a seal surrounding the termination sites when compressed directly against the cable, as seen in FIG. 34. Gaskets 334 are disclosed in greater detail in U.S. patent application Ser. No. 09/170,348 filed Oct. 13, 1998 and assigned to the assignee hereof. When connector is applied at a cable end, an end cap (not shown) may be secured over the cable end and have projections that seat in openings 360 of either the cover or the housing.

Figure 25:
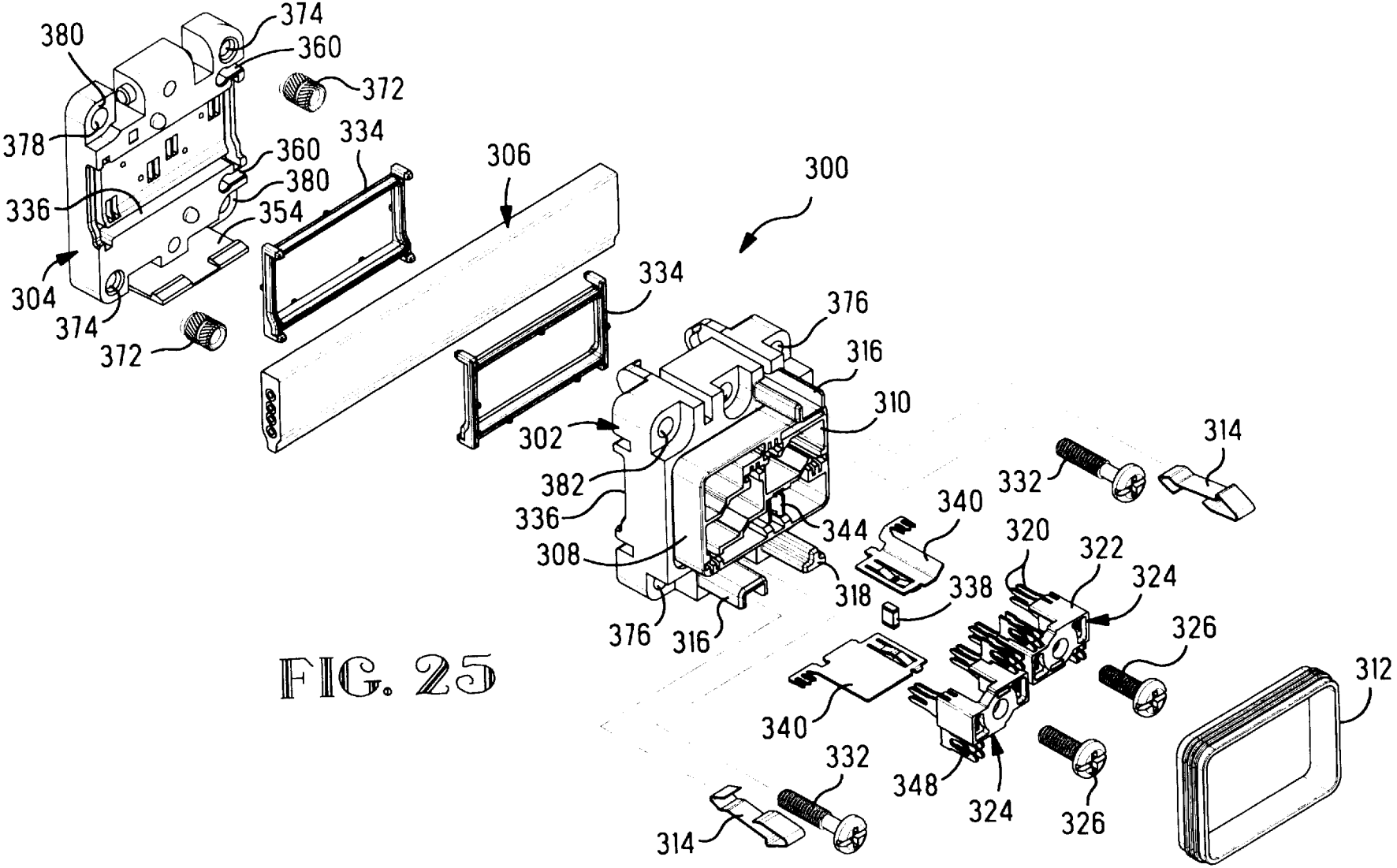
FIG. 25 is an exploded isometric view of the connector of FIG. 24 and showing the components thereof.
Figure 28:
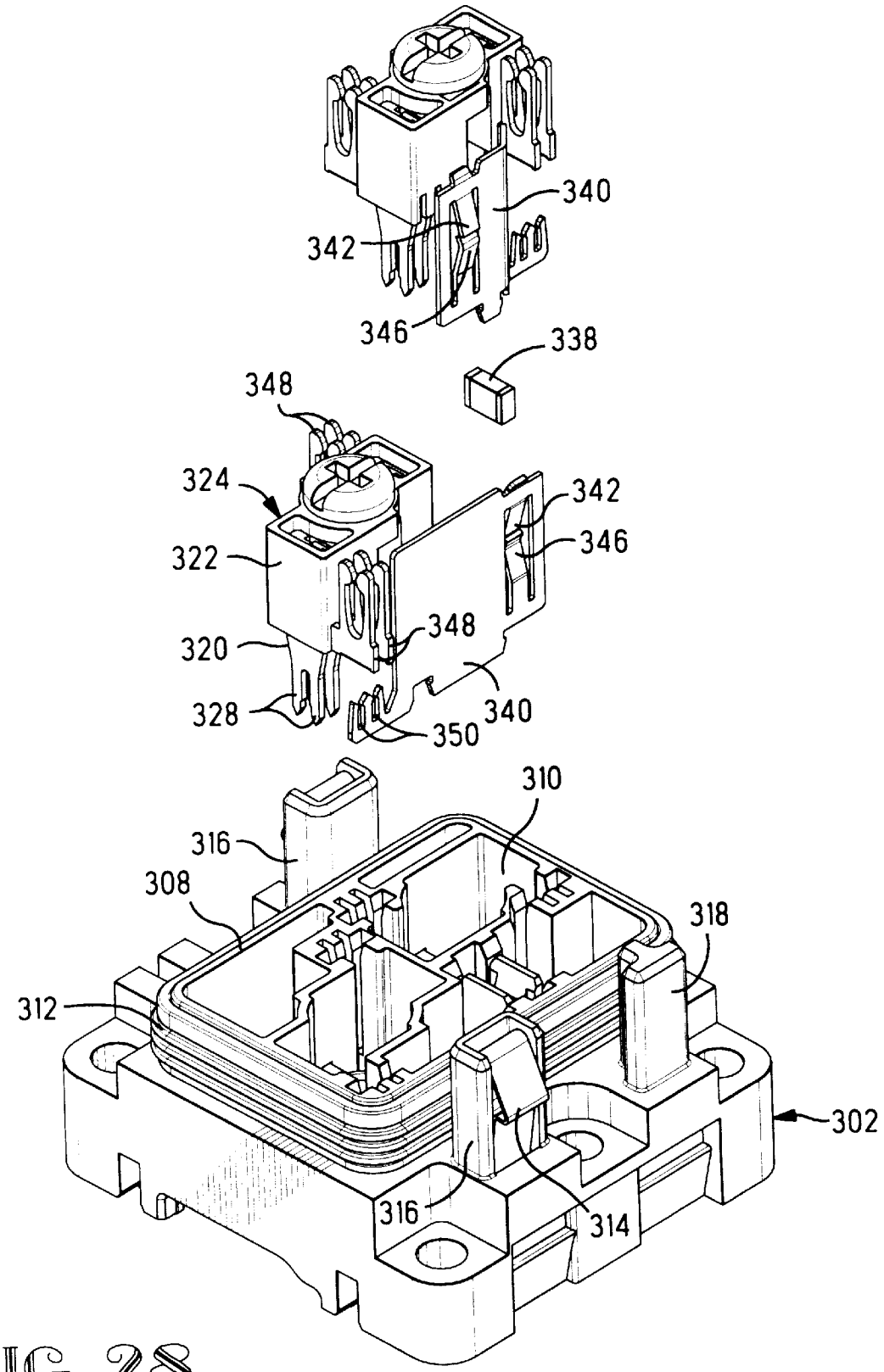
FIG. 28 is an exploded isometric view of the housing of the connector of FIGS. 24 to 27.
Figure 29:
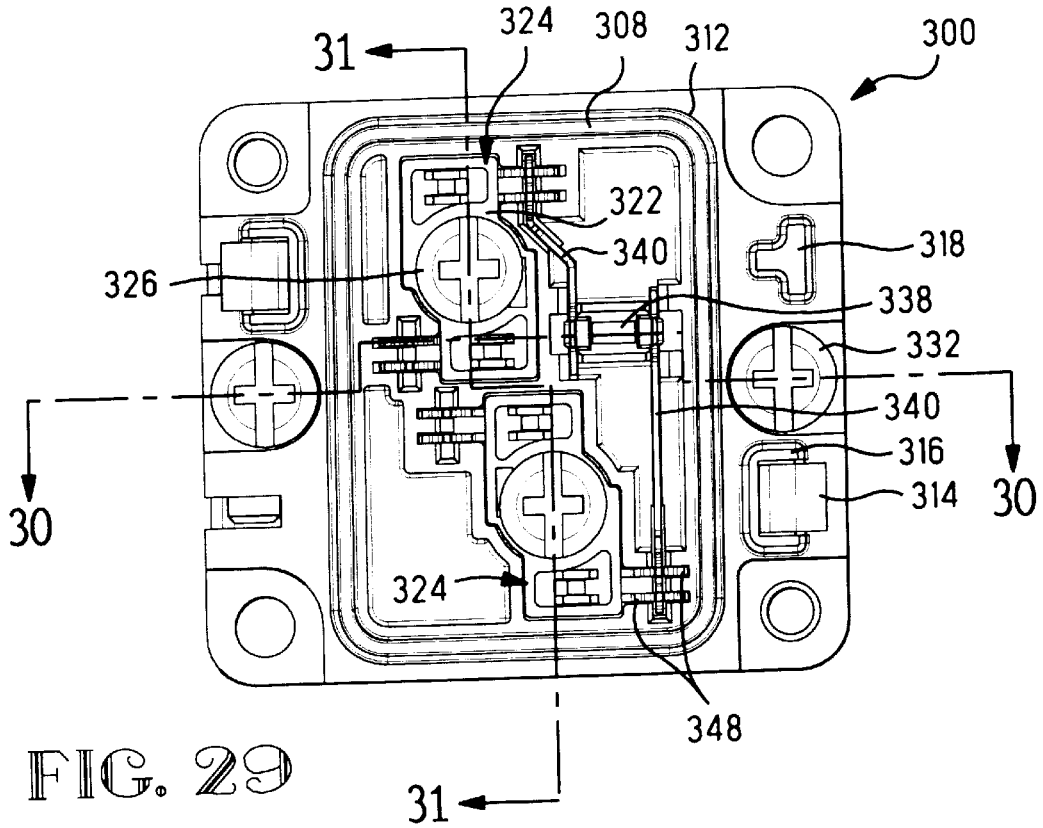
FIG. 29 is a plan view of the mating face of the connector of FIGS. 24 to 28.
Figure 30:
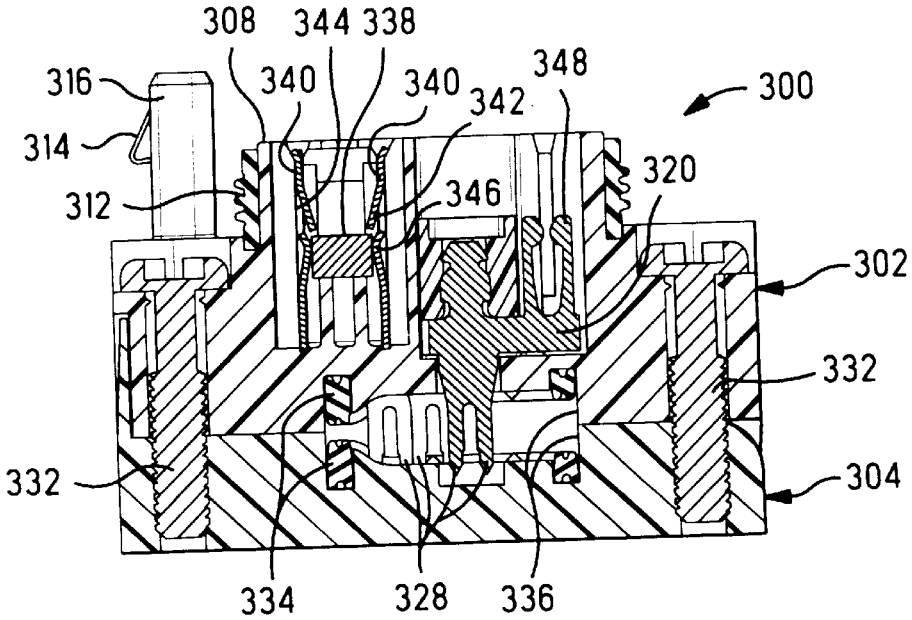
FIGS. 30 and 31 are cross-sectional views of the connector of FIG. 29 taken along lines 30—30 and 31—31 thereof.
Figure 31:
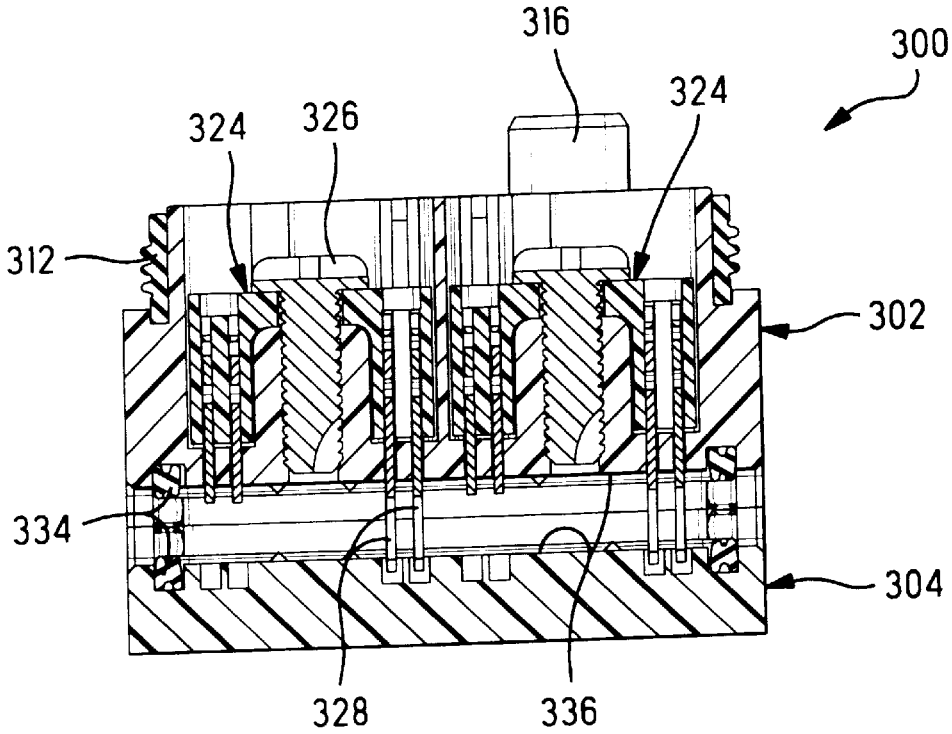
Figure 32:
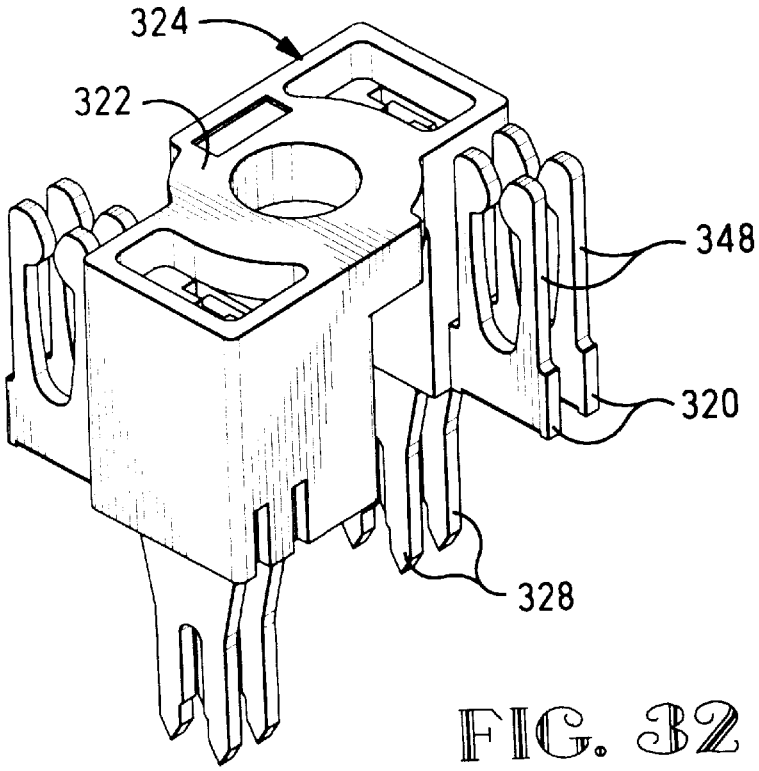
FIG. 32 is in isometric view of a terminal subassembly of the connector of FIGS. 24 to 31.

Connector 300 includes a capacitor 338, as seen in FIGS. 25, 28 and 30, secured in housing 302 by a pair of capacitor-engaging contacts 340. Locking lances 342 of the contacts assure that capacitor 338 is secured in pocket 344, and spring arms 346 of contacts 340 compressively engage the electrodes on opposing sides of the chip capacitor. Capacitor-engaging contacts 340 become electrically connected to contacts 320 associated with power conductors of cable 306 when the connector has been fully assembled, as seen in FIG. 28, with second contact sections 348 of contacts 320 being received into slots 350 of contacts 340. This system for retention of a capacitor in a housing is disclosed in U.S. patent application Ser. No. 09/170,350 filed Oct. 13, 1998 and assigned to the assignee hereof.

Figure 27:
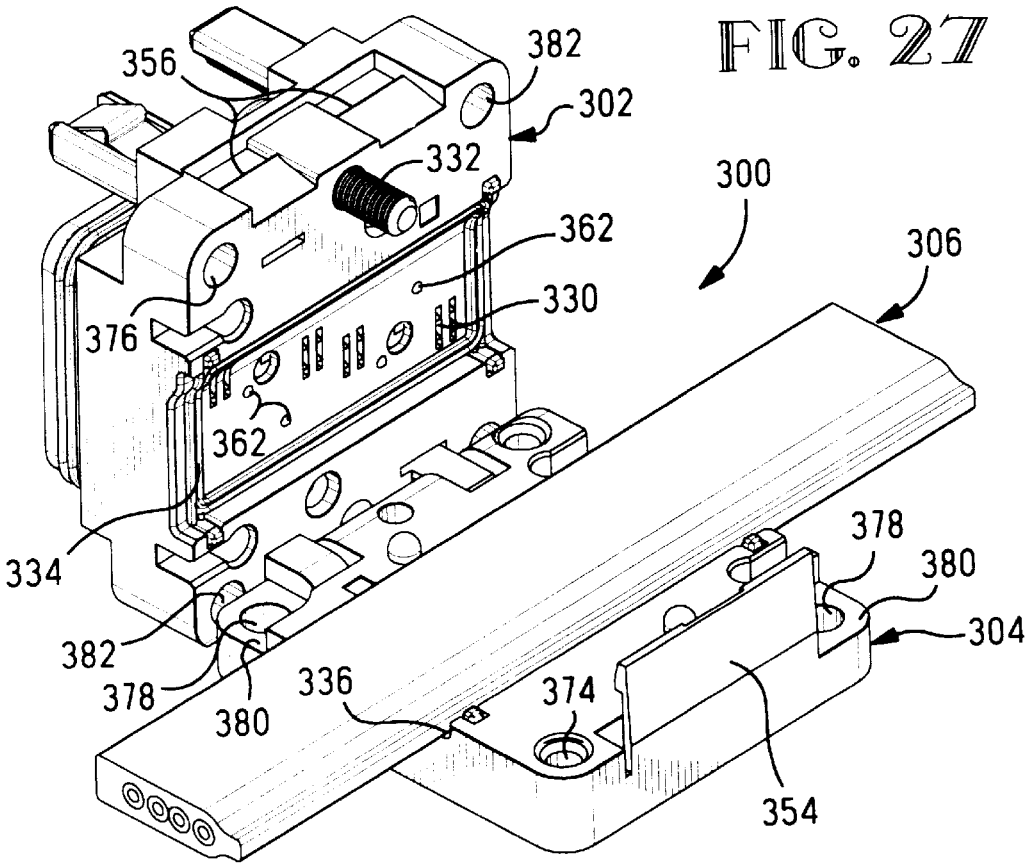
Figure 35:
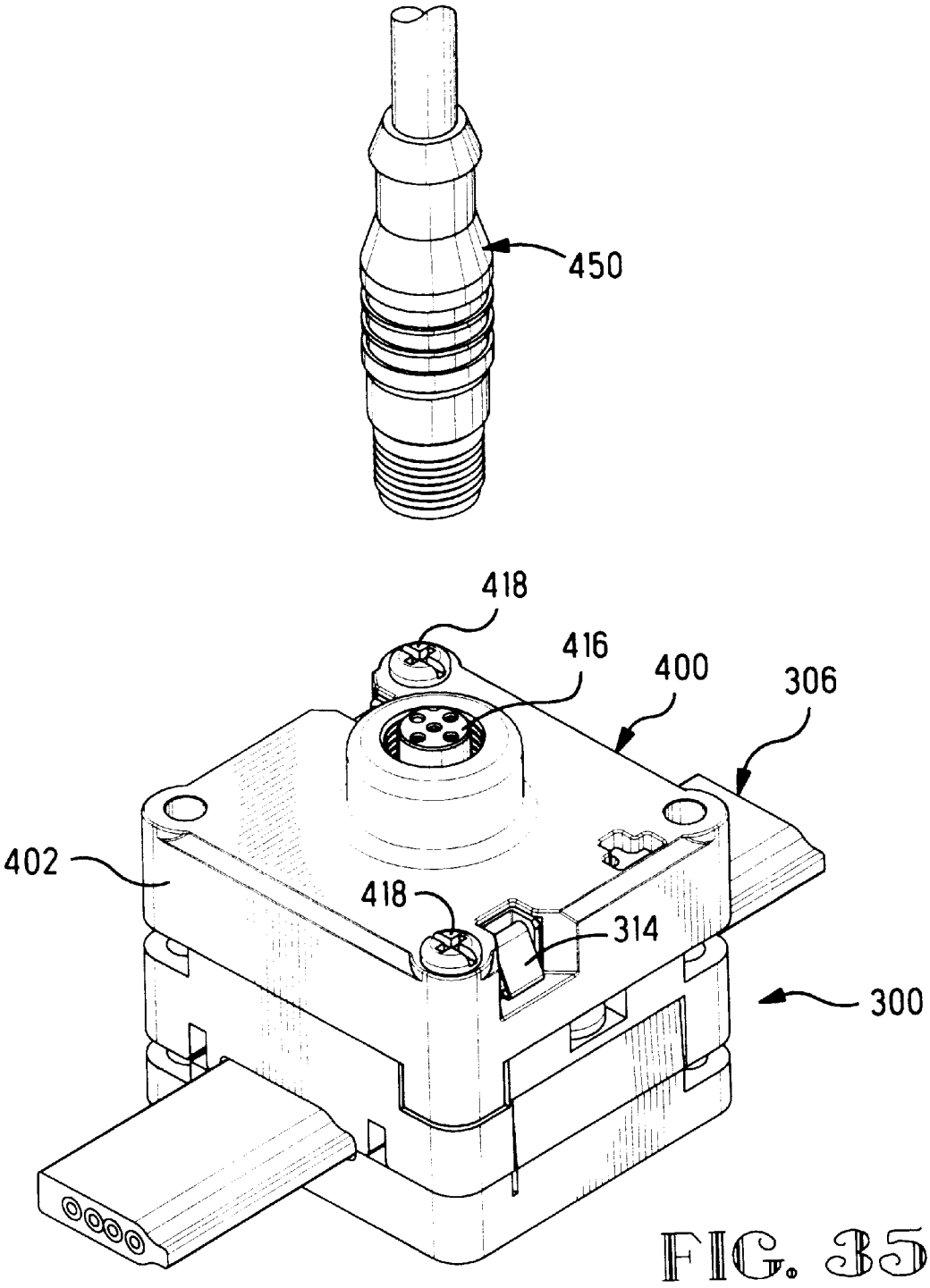
FIG. 35 is an isometric view of the interface module mated with the cable tap connector, with another connector positioned to mate to the interface module.

As seen in FIGS. 25 to 27, teeth 362 extend into cable-receiving grooves 336 to bite into cable 306 to assist in securing the cable in position against lateral movement. Antishear embossments 364 project from assembly face 366 of cover 304 spaced apart from the cable nest to enter clearances 368 in assembly face 370 of housing 302 upon securing the connector to the cable, that enhance resistance to shearing should forces be applied to either the housing or the cover in a lateral direction. Threaded female inserts 372 are preferably affixed within holes 374 of cover 304 at a first pair of opposed corners and aligned with holes 376 of housing 302, for threading thereinto and unthreading therefrom of screws 418 when an interface module has been mated to cable tap connector 300 as seen in FIG. 35. At the second pair of opposed corners, fasteners (not shown) may be inserted into holes 376 for panel mounting or securing a DIN rail clamp (FIG. 2); the cover may be mounted directly to the panel, and clearances 378 are seen for the enlarged fastener head, or elongate fasteners may be inserted through the cable tap connector holes after being inserted through corresponding holes of the interface module.

To assure firm clamping of the cable by cover 304 and housing 302, the cable-engaging surfaces along grooves 336 are slightly closer to each other than a distance less than the nominal thickness of a cable, at least immediately adjacent the termination sites and at the cable exits. Preferably, the plastic-to-plastic surface abutment between housing 302 and cover 304 does not occur prior to the cable-engaging surfaces along grooves 336 compressing the cable insulation. It may be desirable to provide several pairs of opposed low-height ribs (not shown), extending vertically along side surfaces of grooves 336 to center the cable during initial placement, thus serving to precisely locate the cable conductors transversely with respect to the slots of second contact sections 348. Additionally, latch arm 354 may be provided with two latching surfaces (not shown) vertically spaced to provide for latching together to accommodate larger and smaller thicknesses of cable within manufacturing tolerances.

In FIGS. 33 to 35 is shown an interface module 400 matable with cable tap connector 300 along mating face 310. Interface module includes a housing 402 containing four contacts 404 having blade-shaped first contact sections 406 engagable with second contact sections 348 of contacts 320 of connector 300. Preferably contacts 404 are held in housing 402 by an insulative plate 408, and the first contact sections 406 extend forwardly through slots 410 within a cavity 412 that defines a first mating interface 414. Upon mating with connector 300, cavity 412 receives shroud 308 thereinto and side wall surfaces thereof establish sealing engagement with gasket 312 to seal the mating interface. Blade-shaped first contact sections 406 if the interface module enter blade-receiving slots 352 of the cable tap connector within which the tuning fork-shaped second contact sections 348 are recessed.

Interface module 400 also defines a second mating interface 416 opposed from first mating interface 414, to which another electrical connector is matable, such as miniature round cable connector 450. Other second mating interfaces are possible, and interface module 400 is described in greater detail in U.S. patent application Ser. No. 09/170,631 filed Oct. 13, 1999 and assigned to the assignee hereof.

In any of the embodiments, it may be useful to provide indicia on the mating face of the connector to signify a preferred order of actuation, especially with the embodiment of FIGS. 1 to 12. The present invention may be used on cable other than power cable, such as one for signal transmission.

The terminal subassembly of FIGS. 16 to 34 may be used with connectors other than the specific connector disclosed herein, such as a connector utilized with a different cable than that specifically disclosed herein, or utilized with a circuit board or another connector. The contacts of such a terminal subassembly could also have a different construction than that specifically disclosed herein, such as having a spring arm biasable upon actuation against a planar conductor such as of a circuit board to which the housing is mounted.

Additional embodiments may vary from the specific examples disclosed herein, that are within the spirit of the invention and the scope of the claims.

What is claimed is:

1. An electrical connector comprising:

a housing defining a mating face, said mating face including at least one deflectable latch arm extending forwardly from said mating face and beyond a leading transverse end thereof to latchingly engage a cooperating latching section of a mating connector at a latching section of said latch arm, and said housing including a silo extending forwardly from said mating face substantially surrounding said at least one latch arm and therealong to an end thereof in a manner exposing said latching section.

2. An electrical connector as set forth in claim 1 wherein said silo surrounds said at least one latch arm on three sides thereof.

3. An electrical connector as set forth in claim 1 wherein a pair of said latch arms extend forwardly from said mating face on opposed sides thereof, said latching sections face opposite directions, and said silos surround respective ones of said latch arms on three sides thereof while exposing said latching sections thereof.

4. An electrical connector comprising:

a housing defining a mating face and a cable-engaging face, said mating face providing for mating with and unmating from another electrical connector;

at least one contact retained in said housing in a manner permitting movement thereof at least toward said cable-engaging face; and an actuator operatively associated with said at least one contact and including an actuating section exposed along said mating face for actuating said at least one contact for movement toward said cable-engaging face.

5. An electrical connector as set forth in claim 4 wherein said housing includes a shroud surrounding said mating face and said actuating section.

6. An electrical connector as set forth in claim 5 wherein an interfacial seal is disposed around said shroud to seal with a corresponding mating face of a mating connector upon mating, whereby said actuating section is thereby sealed upon connector mating.

7. An electrical connector comprising:

a housing defining a mating face and a cable-engaging face, and a terminal subassembly disposed in said housing in a manner permitting movement of said terminal subassembly at least toward said cable-engaging face;

said terminal subassembly including at least one contact therein having a conductor-engaging section proximate said cable-connecting face to establish an electrical connection with a conductor of a cable along said cable-connecting face upon termination; and said terminal subassembly including an actuator operatively associated with said housing to move said terminal subassembly at least toward said cable-connecting face for said conductor-engaging section of said contact to establish said electrical connection.

8. An electrical connector as set forth in claim 7 wherein said actuator includes an actuating section exposed along said mating face for actuation.

9. An electrical connector as set forth in claim 7 wherein said actuator is insulated from each said at least one contact.

10. An electrical connector as set forth in claim 7 wherein said terminal subassembly includes a plurality of said contacts.

11. An electrical connector as set forth in claim 10 wherein said terminal subassembly is of insulative material and is associated with at least two conductors of said cable, and includes at least one contact associated with each said conductor such that upon actuation said contacts of said terminal subassembly establish electrical connections with said at least two conductors.

12. An electrical connector as set forth in claim 7, said terminal subassembly comprising:

a carrier and said at least one contact affixed in said carrier, and said actuator having a housing-cooperating section and an actuation section such that said carrier is movable relative to said housing upon actuation.

13. A terminal subassembly as set forth in claim 12 wherein said actuator is insulated from each said at least one contact.

14. A terminal subassembly as set forth in claim 13 wherein said carrier includes a plurality of said contacts affixed therein and insulated from each other.

15. A terminal subassembly as set forth in claim 14 wherein said carrier is of insulative material.

16. A terminal subassembly as set forth in claim 15 wherein each said contact includes a planar body section secured in a corresponding slot of said carrier.

17. A terminal subassembly as set forth in claim 15 wherein each said contact includes a conductor-connecting section extending from said carrier.

18. A terminal subassembly as set forth in claim 17 wherein each said contact includes a mating section exposed by said carrier and said actuator to matingly engage a complementary contact.

19. An electrical connector for tapping to a cable for electrical interconnections with conductors thereof, the connector including an insulative housing having a plurality of contacts therewithin, an opposed member, and fastening members for fastening said housing to said opposed member, said housing and said opposed member defining between respective cable faces thereof a cable nest extending between opposed ends such that said cable extends continuously beyond said opposed ends, with said housing and said opposed member adapted to be placed at a selected position along a length of said cable and fastened to each other, with said cable nest conforming to said cable to hold said cable in precise position to align said conductors thereof with respective said contacts, and at least one of said contacts associated with each one of said conductors and having an insulation displacement contact section so positioned in said housing to be aligned with said one of said conductors during termination; characterized in that:

said housing includes at least one actuator in operative relationship with at least one of said contacts for terminating said at least one contact to a said conductor upon actuation thereof; and said housing including slots communicating with said cable face thereof, and each said contact being secured along a respective said slot of said housing and translatable therealong toward said cable nest for said insulation displacement contact section to penetrate an insulative jacket of said cable and to engage and establish an electrical connection with a respective one of said conductors thereof upon actuation.

20. An electrical connector as set forth in claim 19 wherein said cable face of said opposed member includes slots opposed to said slots of said housing to receive ends of said insulation displacement contact sections of said contacts thereinto upon full actuation.

21. An electrical connector as set forth in claim 19 wherein said cable face of at least one of said housing and said opposed member include projections spaced from said cable nest and the other of said housing and said opposed member includes corresponding recesses to receive said projections thereinto when said housing and said opposed member are fastened to each other about said cable, to enhance resistance of relative movement of said housing with respect to said opposed member after fastening.

22. An electrical connector as set forth in claim 19 wherein said fastening members are positioned to both sides of said cable nest in apertures of said housing aligned with corresponding apertures of said opposed member to be threaded thereinto when said connector is positioned at said selected position along said cable.

23. An electrical connector as set forth in claim 14 wherein each said contact includes a female contact section recessed within another slot of said housing that is defined along said cable-remote face.

24. An electrical connector as set forth in claim 23 wherein two said contacts are associated with each said conductor, and said female contact sections of each said two contacts are recessed within respective said slots, and said housing defines a blade-receiving slot intersecting said respective slots for receipt of a blade contact section of a single said mating contact to mate with said female contact sections of said two contacts.

25. An electrical connector as set forth in claim 19 wherein said cable-remote face of a housing defines a mating interface, and each said contact includes a second contact section exposed along said mating interface for mating with a complementary contact of a mating interface module to interconnect said complementary contact with said respective conductor.

26. An electrical connector as set forth in claim 25 wherein said opposed member includes at least two apertures thereinto at respective corners of said cable face thereof for threaded receipt thereinto of fasteners extending through apertures of said housing aligned with said apertures of said opposed member, for securing a mating connector to said mating interface.

27. An electrical connector as set forth in claim 26 wherein said apertures of said opposed member include therein respective threaded female inserts cooperable with a threaded shaft of a said fastener.

28. An electrical connector as set forth in claim 25 wherein said housing includes a shroud surrounding said contact sections of said contacts, and said housing includes at least one latch arm projecting from said cable-remote face outwardly of said shroud to latchingly engage a cooperating section of a said mating interface module for retention of said connector and said mating interface module in a mated condition.

29. An electrical connector as set forth in claim 28 wherein each said at least one latch arm is disposed in a silo projecting from said housing and surround three sides of said latch arm in a manner exposing the latching surface thereof for latching with a mating interface module.

30. An electrical connector as set forth in claim 29 wherein said housing includes two said latch arms disposed in respective said silos, and said silos have chamfered leading ends to adjust the relative positioning of said mating interface module when received into corresponding apertures of the module to assure alignment of the mating contacts with said contact sections.

31. An electrical connector as set forth in claim 30 wherein said housing includes a polarizing projection for entering a corresponding projection-receiving cavity of said mating interface module to assure appropriate orientation of said mating interface module prior to mating.

32. An electrical connector as set forth in claim 19 wherein each said actuator is associated with each said conductor of said cable and is mounted in said housing in a manner adapted to move at least one said contact associated with said conductor toward said cable face during actuation to be terminated to said conductor.

33. An electrical connector as set forth in claim 32 wherein each said actuator engages two said contacts to move said two contacts simultaneously toward said cable face to terminate both said contacts to a common conductor of said cable.

34. An electrical connector as set forth in claim 33 wherein said actuator includes an actuating section exposed along a cable-remote face of said housing.

35. An electrical connector as set forth in claim 19 wherein contacts for two said conductors are mounted in a terminal subassembly containing said actuator, to move said contacts simultaneously toward said cable face to terminate said two conductors.

36. An electrical connector as set forth in claim 35 wherein said terminal subassembly includes a pair of said contacts for each said conductor.

37. An electrical connector as set forth in claim 35 wherein said terminal subassembly includes an insulative insert movable along a corresponding cavity of said housing during actuation of said actuator, with said insulation displacement contact sections of said contacts depending therefrom to be translated along respective slots of said housing communication with said cable face of said housing.

38. An electrical connector as set forth in claim 37 wherein said actuator includes a threaded shank threadable into an aperture of said housing during actuation to translate said terminal subassembly along said cavity.

39. An electrical connector as set forth in claim 37 wherein each said contact includes a contact section projecting from a side of said insert to be received along a corresponding slot of said housing in communication with said cavity, with said corresponding slot adapted to permit said contact section to be translated toward said cable face during actuation thereof.

40. An electrical connector as set forth in claim 39 wherein each said contact section is a female contact section and two said contacts are associated with each said conductor, and said housing defines a blade-receiving slot intersecting said respective slots for receipt of a blade contact section of a single said mating contact to mate with said female contact sections of said two contacts.

* * * * *